US010258857B2

(12) United States Patent
Bognanno

(10) Patent No.: US 10,258,857 B2
(45) **Date of Patent: *Apr. 16, 2019**

(54) SPORTS TRAINING SAFETY SYSTEM AND METHOD OF OPERATION THEREOF

(71) Applicant: De-Cleat Technology, LLC, San Jose, CA (US)

(72) Inventor: John Bognanno, San Jose, CA (US)

(73) Assignee: De-Cleat Technology, LLC, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/728,772

(22) Filed: Oct. 10, 2017

(65) Prior Publication Data

US 2018/0028892 A1 Feb. 1, 2018

Related U.S. Application Data

(63) Continuation of application No. 14/295,960, filed on Jun. 4, 2014, now Pat. No. 9,782,653.

(60) Provisional application No. 61/831,110, filed on Jun. 4, 2013.

(51) Int. Cl.
*A63B 69/34* (2006.01)

(52) U.S. Cl.
CPC ..... *A63B 69/345* (2013.01); *A63B 69/34* (2013.01); *A63B 2209/08* (2013.01); *A63B 2210/50* (2013.01); *A63B 2220/40* (2013.01); *A63B 2220/56* (2013.01); *A63B 2220/801* (2013.01); *A63B 2220/803* (2013.01); *A63B 2220/805* (2013.01); *A63B 2220/806* (2013.01); *A63B 2220/807* (2013.01)

(58) Field of Classification Search
CPC ... A63B 69/345; A63B 69/34; A63B 2220/56; A63B 2220/40; A63B 2220/805; A63B 2209/08; A63B 2220/807; A63B 2220/803; A63B 2220/801; A63B 2210/50; A63B 2220/806
See application file for complete search history.

(56) References Cited

U.S. PATENT DOCUMENTS

| | | | |
|---|---|---|---|
| 1,717,693 | A | 6/1929 | Klum |
| 3,397,885 | A | 8/1968 | Nash, Jr. |
| 5,171,009 | A | 12/1992 | Filewich et al. |
| 7,736,248 | B2 | 6/2010 | Eldridge |
| 8,790,198 | B1 | 7/2014 | Russell |
| 9,782,653 | B2 | 10/2017 | Bognanno |
| 2006/0201580 | A1 | 9/2006 | Kang |
| 2008/0156205 | A1 | 7/2008 | Hering |

(Continued)

OTHER PUBLICATIONS

United States Patent and Trademark Office, U.S. Appl. No. 14/295,960, Final Office Action dated Mar. 15, 2016.

(Continued)

*Primary Examiner* — Gene Kim
*Assistant Examiner* — Jeffrey Vanderveen
(74) *Attorney, Agent, or Firm* — Wong & Rees LLP; Kirk D. Wong

(57) ABSTRACT

A sports training safety system (100) and method of operation (2000) thereof includes: a training dummy (105); a magnetic release (160) attached to the training dummy (105); a delivery carriage (150) mounted to the magnetic release (160); a delivery rail (130) for supporting the delivery carriage (150); and a transport system (165), attached to the delivery rail (130), for moving the delivery carriage (150) and the training dummy (105) along the delivery rail (130).

18 Claims, 17 Drawing Sheets

(56) References Cited

U.S. PATENT DOCUMENTS

| | | | |
|---|---|---|---|
| 2009/0161284 | A1 | 6/2009 | Maraval |
| 2014/0357430 | A1 | 12/2014 | Bognanno |

OTHER PUBLICATIONS

United States Patent and Trademark Office, U.S. Appl. No. 14/295,960, Non-Final Office Action dated Dec. 7, 2016.
United States Patent and Trademark Office, U.S. Appl. No. 14/295,960, Notice of Allowance dated Jun. 27, 2017.

SPORTS TRAINING SAFETY SYSTEM AND METHOD OF OPERATION THEREOF

CROSS-REFERENCE TO RELATED APPLICATIONS

This application claims benefit as a Continuation of application Ser. No. 14/295,960, filed Jun. 4, 2014, which claims benefit of U.S. Provisional Application Ser. No. 61/831,110, filed on Jun. 4, 2013 the entire contents of the aforementioned are hereby incorporated by reference as if fully set forth herein, under 35 U.S.C. § 120. The applicant(s) hereby rescind any disclaimer of claim scope in the parent application(s) or the prosecution history thereof and advise the USPTO that the claims in this application may be broader than any claim in the parent application(s).

TECHNICAL FIELD

The present invention relates generally to sports training and more particularly to a system for sports training safety.

BACKGROUND ART

Contact sports provide great exercise, recreation, and entertain benefits but the risks to personal injury require safe methods of training at every performance level. Athletes and martial artist still practice using tools and equipment developed years ago. The current training equipment is often static, awkward, and manually driven. Further, padded equipment and dummies still require manual operation by coaches and teammates adding to fatigue, higher risk of personal injury, and wasted time and resources.

Further, current training equipment and tools do not provide or mimic environments and conditions that closely represent real game time conditions. Because of additional safety concerns, players and athletes also hold back and do not use their full strength, further preventing practice of real game time conditions.

Thus, the continued risk to athletes and enthusiast present the need to incorporate modern technologies and methods to solve the problems with current sports training methods. In view of the ever-increasing need to improve safety, provide better training, and improve efficiencies, it is more and more critical that answers be found to these problems.

Solutions to these problems have been long sought but prior developments have not taught or suggested any solutions and, thus, solutions to these problems have long eluded those skilled in the art.

DISCLOSURE OF THE INVENTION

The present invention provides a method of operation of a sports training safety system including: providing a frame having a delivery carriage and a magnetic release, the delivery carriage attached between the frame and the magnetic release; attaching a training dummy to the magnetic release; transporting the training dummy to a target location along the frame; and releasing the training dummy from the magnetic release based on the target location.

The present invention provides a sports training safety system including: a training dummy; a magnetic release attached to the training dummy; a delivery carriage mounted to the magnetic release; a delivery rail for supporting the delivery carriage; and a transport system, attached to the delivery rail, for moving the delivery carriage and the training dummy along the delivery rail.

Certain embodiments of the invention have other steps or elements in addition to or in place of those mentioned above. The steps or elements will become apparent to those skilled in the art from a reading of the following detailed description when taken with reference to the accompanying drawings.

BEST MODE FOR CARRYING OUT THE INVENTION

Figure 1:
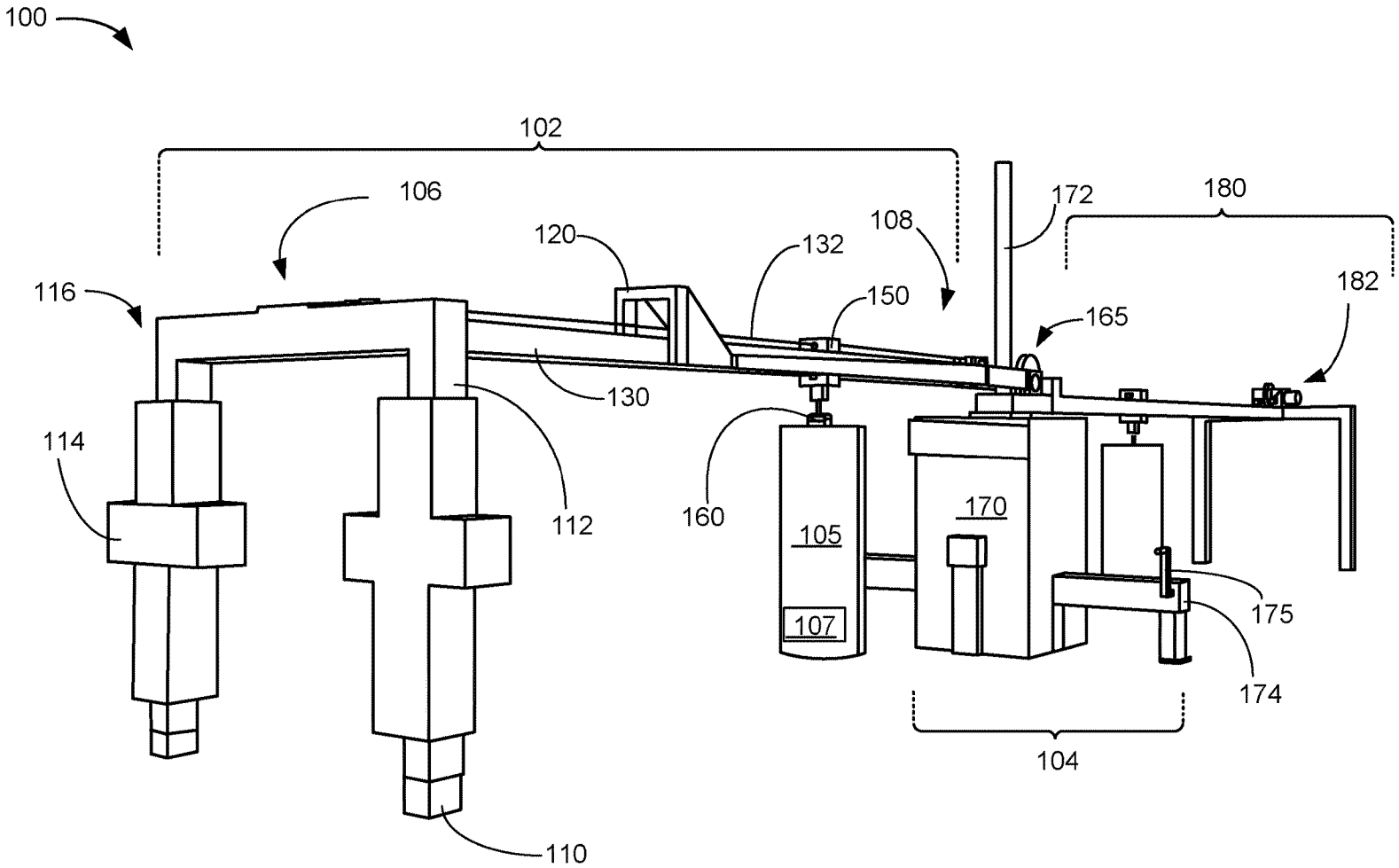
FIG. 1 is an isometric side view of a sports training safety system in a first embodiment of the present invention.

The following embodiments are described in sufficient detail to enable those skilled in the art to make and use the invention. It is to be understood that other embodiments would be evident based on the present disclosure, and that system, process, or mechanical changes may be made without departing from the scope of the present invention.

In the following description, numerous specific details are given to provide a thorough understanding of the invention. However, it will be apparent that the invention may be practiced without these specific details. In order to avoid obscuring the present invention, some well-known devices, instrument configurations, and process steps are not disclosed in detail.

For expository purposes, the term "horizontal" as used herein is defined as a plane parallel to the ground, which the system sits on, regardless of its orientation. The term "vertical" refers to a direction perpendicular to the horizontal as just defined. Terms, such as "above", "below", "bottom", "top", "side" (as in "sidewall"), "higher", "lower", "upper", "over", and "under", are defined with respect to the horizontal, as shown in the figures.

The term "on" means there is direct physical contact between elements. The term "directly on" means there is direct physical contact between elements with no intervening elements. The term "modular" refers to parts or components that can be interchangeable with other parts of components.

Also, in the following description, connected and coupled are used to describe a relationship between two members. The term "connected" means that the two members are physically and directly joined or attached to each other. The term "coupled" means that the two members are physically linked through one or more other members.

The drawings showing embodiments of the system are semi-diagrammatic and not to scale and, particularly, some of the dimensions are for the clarity of presentation and are shown exaggerated in the drawing FIGs. Similarly, although the views in the drawings for ease of description generally show similar orientations, this depiction in the FIGs. is arbitrary for the most part.

The present invention improves safety in sports and physical activity including most full contact sports including American Football. The present invention provides a system of equipment that allows athletes to practice the required contact techniques in an environment that closely represents live game conditions. The object of the present invention is to allow athletes the ability to effectively train contact techniques by striking a training or tackling dummy that is suspended from an apparatus and presented to the athlete in motion allowing the athlete to strike a moving target.

The present invention provides a system for contact tackling training including information gathering devices focused on creating a safer environment for the participant to refine the techniques necessary to execute the required contact events in various activities. This is accomplished through the use of an apparatus that leverages a training or tackling dummy as the primary contact target.

Tackling dummies are heavily padded allowing participants to strike the tackling dummy with maximum force while significantly reducing risk of injury and wear and tear on the individual. It allows participants to practice the required blocking and tackling techniques with or without the need for personal protective equipment in an environment that resembles "real time" live event conditions. This is enabled by developing a "tackling dummy that is detachable by means of a magnetic or electro-magnetic connection. When the dummy is struck by the participant, the dummy will detach from the apparatus allowing the participant to safety complete the contact event.

Furthermore, the present invention includes information gathering devices capable of leveraging cutting-edge-sensor technology to collect, simulate, analyze and visually depict an athlete's body position before, during and after the collision event. Sensor technology includes but is not limited to an electro-magnetics, 3-axis and 4-axis accelerometers, gyroscopes, proximity sensors, high speed image-sensor technology as well as the latest generation of mixed-signal and digital processing technologies.

Referring now to FIG. 1, therein is shown an isometric side view of a sports training safety system 100 in a first embodiment of the present invention. The sports training safety system 100 includes a frame 102, an apparatus hub 104, and a training dummy 105. The frame 102 and the apparatus hub 104 sit on the ground and both are anchored by legs or support structures.

The frame 102 includes the supporting structures for the training dummy 105. A peripheral portion of the frame 102 can be attached to the apparatus hub 104. The sports training safety system 100 can include an end frame side 106 at the peripheral end of the frame 102 away from the apparatus hub 104. The sports training safety system 100 can also include a hub side 108 of the frame 102 directly over the apparatus hub 104 and opposite from the end frame side 106.

The apparatus hub 104 is a supporting structure that can house mechanical and electronic components of the sports training safety system 100. The apparatus hub 104 will be explained in detail below.

The frame 102 can include a caster system 110, end frame legs 112, a delivery rail 130, and an end frame hand shield 114. The caster system 110 is a set of wheels for moving the legs of the sports training safety system 100.

The caster system 110 can include single, double, or compound wheels that are mounted to the bottom portion of the legs or other supporting structures. The caster system 110 can include swivel casters, braking and locking casters, a single wheel caster, a spherical wheel caster, an omni wheel caster, or a combination thereof as examples.

The end frame legs 112 can include two parallel posts or pillars for supporting the end frame side 106 of the sports training safety system 100. The end frame legs 112 are attached to the caster system 110. The caster system 110 allows the end frame side 106 of the frame 102 to be moved.

For example, it has been found that the caster system 110 allows the end frame side 106 of the frame 102 to be moved in a lateral orbit around the apparatus hub 104. Further, the caster system 110 can allow 360 degree movement of the end frame legs 112 on the ground.

The end frame legs 112 can include an end frame hand shield 114. The end frame hand shield 114 is a protective padding that surrounds the end frame legs 112. The end frame hand shield 114 can be attached and detached to each of the end frame legs 112.

The end frame hand shield 114 can be padded to prevent collision injury to a user. For example, the end frame hand shield 114 can include cross pads that cover the metal portions of the end frame legs 112 for preventing injury. It has found that the end frame hand shield 114 provides a training obstacle and targets for a user to avoid when practicing tackles on the training dummy 105.

The frame 102 can include the delivery rail 130, which is a support structure for suspending the training dummy 105 off the ground. The delivery rail 130 can include a single rail or a double rail configuration.

The frame 102 can also include a modular delivery rail support frame 116. The modular delivery rail support frame 116 can include the end frame legs 112 and forms the base of an upside down "U" or "A" with the end frame legs 112. The modular delivery rail support frame 116 can be attached and detached from the delivery rail 130 at the end frame side 106.

The frame 102 can include a cable delivery 132, a support frame 120, and a delivery carriage 150. The cable delivery 132 is a wire, chain, or cable conveyor system for transporting the training dummy 105.

The cable delivery 132 includes chains, cables, or wires for moving the training dummy 105 along the delivery rail 130. The cable delivery 132 can include one or more chains or cables. The cable delivery 132 runs along the delivery rail 130 from the modular delivery rail support frame 116 to the apparatus hub 104.

The support frame 120 is a structure for supporting the delivery rail 130. The support frame 120 can include a harness or bracket that is attached to the delivery rail 130 near the end frame side 106 of the frame 102. The support frame 120 can be attached to a portion of the apparatus hub 104 for suspending the delivery rail 130 over the ground. The support frame 120 can be adjustable and can slide along the delivery rail 130.

The delivery carriage 150 is a housing or cable grip for carrying the training dummy 105 along the delivery rail 130. For example, the delivery carriage 150 can be a grip positioned between two rails of the delivery rail 130. The delivery carriage 150 can be detachable or permanently non-detachable to the delivery rail 130 based on the model of the sports training safety system 100.

The delivery carriage 150 can be free-floating in relationship with the delivery rail 130 and can be attached to an independent motorized system. For example, the delivery carriage 150 can be free standing. Further, multiple instances of the delivery carriage 150 can be mounted on the delivery rail 130, which provides for the ability to conduct multiple tackles with multiple users operating the system at the same time.

Further, it has been found that the delivery carriage 150 allows the training dummy 105 to be tackled in any direction providing flexibility and realistic practice environments for sports training. Further, multiple users can simultaneously practice tackling if multiple carriages are mounted to the delivery rail 130.

A magnetic release 160 can be attached to the delivery carriage 150. The magnetic release 160 is a device for attaching and detaching the training dummy 105 from the delivery carriage 150. The magnetic release 160 can include multiple options for connector types and can include a modular part that is mounted to the delivery carriage 150.

A first type of connector can include a plurality of magnets, where the number of magnets used will be determined by the weight of the training dummy 105. A second type can include an electromagnet and a controller system for the electromagnet. The connector types for the magnetic release 160 will be explained in greater detail below.

The training dummy 105 is attached to the magnetic release 160 and is suspended below the delivery rail 130. The magnetic release 160 allows the training dummy 105 to be detachable and easily reattached.

It has been found that the training dummy 105 can be interchanged based on the sport and the intended use of the sports training safety system 100. For example, the training dummy 105 can also include modular and interchangeable dummy types. The interchangeable types of the training dummy 105 can provide training in virtually all sports or activities where the potential for collisions between participants can be modeled by the system to leverage additional solutions for refining, studying, and optimizing contact techniques necessary to improve sports performance.

For example, the training dummy 105 can be modeled to include an American football player's silhouette or profile. Further for example, the training dummy 105 can also be modeled to include a soccer or international football silhouette or profile. The training dummy 105 can also include configurations for martial arts training with limbs configured in different positions.

The magnetic release 160 can be used to control the detachment of the training dummy 105. For example, in an electromagnet configuration, the sports training safety system 100 can use a sensor 107 to provide intelligence in disengaging the electromagnet for releasing the training dummy 105. This provides for less wear and tear for users and for the mechanical components of the system. The magnet configuration can release the training dummy 105 based on physical force applied.

The sensor 107 can be embedded in the training dummy 105 and other locations of the frame 102. A plurality of the sensor 107 can be mounted to various locations of the sports training safety system 100 including the frame 102 and the apparatus hub 104. The sensor 107 can include accelerometers, inertial sensors, gyroscopes, cameras, and motion sensors. For example, the sensor 107 can include a motion sensor, a camera sensor, trip wires, laser trip wires, a pressure sensor, a gyroscope sensor, and an accelerometer. The sensor 107 can also be used for recording data such as biomechanical data and impact readings.

A transport system 165 can be attached to the delivery rail 130 of the frame 102 for moving the delivery carriage 150 forward and back along the delivery rail 130. The transport system 165 can include an electric motor to drive the system. The transport system 165 can include chains, cables, wires, magnetic levitation, or a combination thereof to control the movement of the delivery carriage 150.

It has been found that the use of an electric motor to power and drive the transport system 165 provides torque, pulling power, and greater control and stopping accuracy over the movement of the delivery carriage 150. For example, the electric motor can provide different speeds, accelerations, and stopping points, which can mimic a human opponent in real life game situations and allow better safety training.

The transport system 165 can include a chain-based delivery system or a cable pulley system. The chain-based system can use a strong chain to facilitate control over the delivery carriage 150 attached to the chain. Metal chains provide structural reliability and performance reliability for moving the delivery carriage 150 at a desired speed. The structural strength of a chain-based system can provide for desired acceleration and velocity profiles similar to that in a live game environment.

The transport system 165 can also include a cable pulley system or motorized pulley wheel delivery system. The transport system 165, including a pulley system, can have cables and gears attached to a bull-wheel, prime mover, or other motor powered cable system.

Further, it has been found that the transport system 165 and the cable delivery 132 include the ability to accelerate and decelerate the training dummy 105 at any location along the delivery rail 130. This control over the movement of the delivery carriage 150 provides for mimicking the behavior and actions of human opponents during real-life sporting conditions. The specifications and performance can be determined by the torque and acceleration capabilities of the specified motors.

The modular delivery rail support frame 116 and the end frame legs 112 can include proximity sensors and cameras for collecting sports performance and biomechanical information. The sensors, such as the sensor 107, and cameras can be mounted at the end of the delivery rail 130 to optimize the viewing angle of the contact event. Further, sensors and cameras can also be mounted at various locations on the frame and the apparatus hub 104. The sensor 107 can be used to trigger the release of the training dummy 105.

The apparatus hub 104 can include a center hub 170, a boom support 172, and a center hub support 174. The center hub 170 is arranged at the hub side 108 of the frame 102. The center hub 170 can house a power supply, additional motors, operating controls, and sensor systems. The center hub 170 can also support the transport system 165 and the prime mover for the rail system.

The boom support 172 can be attached to the support frame 120 for suspending the delivery rail 130 off the ground. The boom support 172 vertically extends from the center hub 170 and is attached to the delivery rail 130 at the hub side 108 of the frame 102.

The center hub support 174 provides anchoring and support for the center hub 170 to the ground. The center hub support 174 can include legs that ensure that the center hub 170 does not tip over. The center hub support 174 can include two, three, or four legs based on the configuration of the sports training safety system 100. The center hub support 174 can be removed and reattached.

The center hub support 174 can include the caster system 110 on each leg for moving the apparatus hub 104 in 360 degrees of lateral movement on the ground. The center hub support 174 can include a latch 175. The latch 175 can be used for adjusting the height of the center hub support 174 and for removing components of the center hub support 174.

The sports training safety system 100 can include an additional delivery system or a secondary delivery system 180 that is attached to the center hub 170 and extends in a direction opposite to the end frame side 106 of the frame 102. The secondary delivery system 180 can include a second frame with all the components of the primary frame. The secondary delivery system 180 can include a second transport system 182 mounted over the support legs opposite from the apparatus hub 104 and the end frame side 106.

It has been found that the secondary delivery system 180 allows users to train on a second dummy and provides for simultaneous use of the sports training safety system 100 by multiple users. Further, the sports training safety system 100 can include additional delivery systems extending from all four lateral sides of the center hub 170. Thus an entire sporting team can conduct efficient practices with the sports training safety system 100.

Further, it has been discovered that the sports training safety system 100 with a movable magnetic detachable target for the training dummy 105 increases sports training safety by providing a moving target for a realistic contact environment, which is designed to provide training to minimize the risk of physical trauma to the athlete.

It has been found that the sports training safety system 100 with the magnetic detachable training dummy on the delivery rail 130 increases user skill and proficiency by allowing the athlete to repetitively train contact techniques on a moving target to create the muscle memory necessary to get into a safer and more powerful contact position at impact.

The sports training safety system 100 provides the benefit of leveraging a tackling apparatus, such as the training dummy 105 in conjunction with an athlete using the system to "model" contact positions in a controlled environment. Various types and variations of the training dummy 105 can be used to practice tackling positions and athletic skills.

It has been discovered that the sports training safety system 100 increases safety and physical longevity to both athletes and training partners by reducing the impact between the user and the training dummy 105, allowing athletes to train longer while minimizing wear and tear on the body with easily detachable dummies. This methodology also reduces the amount of force/torque the physical apparatus will need to withstand during contact events with the training dummy 105.

It has been discovered that the sports training safety system 100 with the magnetic detachable dummy provides risk management by diminishing the possibility of injury to key athletes while improving required contact techniques with a more controlled tackling environment. Training partners are also not at risk because the sports training safety system 100 replaces the need for manual operation of pads and training dummies.

It has been discovered that the sports training safety system 100 can include a mechanical switch on the magnetic release 160 for controlling the movement of the training dummy 105. The switch increases safety to athletes by disengaging the cables, motor, and moving parts of the system when the training dummy 105 is detached.

It has been discovered that the sports training safety system 100 with the magnetic release 160 can situate real game conditions by including a number of magnets determined by the weight of the training dummy 105, which can mirror the weight of the user and mimic a similar sized opponent. The magnetic release 160 also provides the benefit of being easy to detach on contact, which reduces the risk of injury to the user and mirrors the fall of an opponent. The magnetic connection also provides the benefit of being easy to reattach to the delivery carriage 150, increasing the efficiency of training sessions.

It has been discovered that the sports training safety system 100 with the electro-magnetic connection for the magnetic release 160 can situate real game conditions by allowing the attachment of various training dummies of different weight and limb configurations, thus mirroring different sized opponents and situations.

Further, it has been discovered that the electro-magnetic connection for the magnetic release 160 also provides the benefit of being able to adjust the strength of the connection with the training dummy 105 and thus training the user to tackle a large, stronger, or harder variant of the training dummy 105. The magnetic release 160 can us electromagnets, which provide the benefit of holding all different types of the training dummy 105, regardless of weight but automatically detaching the dummy to prevent injury and hard contact to a user.

It has been discovered that the electromagnetic connection of the magnetic release 160 can detach the training dummy 105 using motion sensor, i.e., accelerometer, camera sensors, inertial sensor, or gyroscopes for increasing physical safety to the user during impact. For example, when the training dummy 105 is struck by the participant, the motion sensor will act as a switch, triggering the motor to stop by signaling the motor, and for the training dummy 105 to release by disabling the current to the electromagnet, which decreases impact and wear and tear on the user.

It has been discovered that the sports training safety system 100 includes a modular deliver rail support frame 116 that can be removed to allow more free space for open filed tackling. Further, it has been discovered that the sports training safety system 100 includes the support frame 120 that can be moved towards the end of the delivery rail 130 for supporting the end frame side 106 of the frame if the modular deliver rail support frame 116 is removed. The support frame 120 is attached to cables supports and the boom support 172 for holding up the end frame side 106 of the delivery rail 130.

It has been discovered that the sports training safety system 100 with the sensor 107 that includes analog sensors, gyroscopes, and proximity sensors to incorporate a real-time contact position data collection function through the use of analog circuitry (sensors, op-amps, Analog-to-digital converter (ADC)/digital-to-analog converter (DAC), power management and microcontroller or CPU) to perform advanced data capture as the participant strikes the training dummy 105. The real-time contact position data collection will be achieved either through a direct electrical or a wireless connection to the host processing unit providing feedback information, such as biomechanical and kinesiology information and feedback to coaches and trainers.

Figure 2:
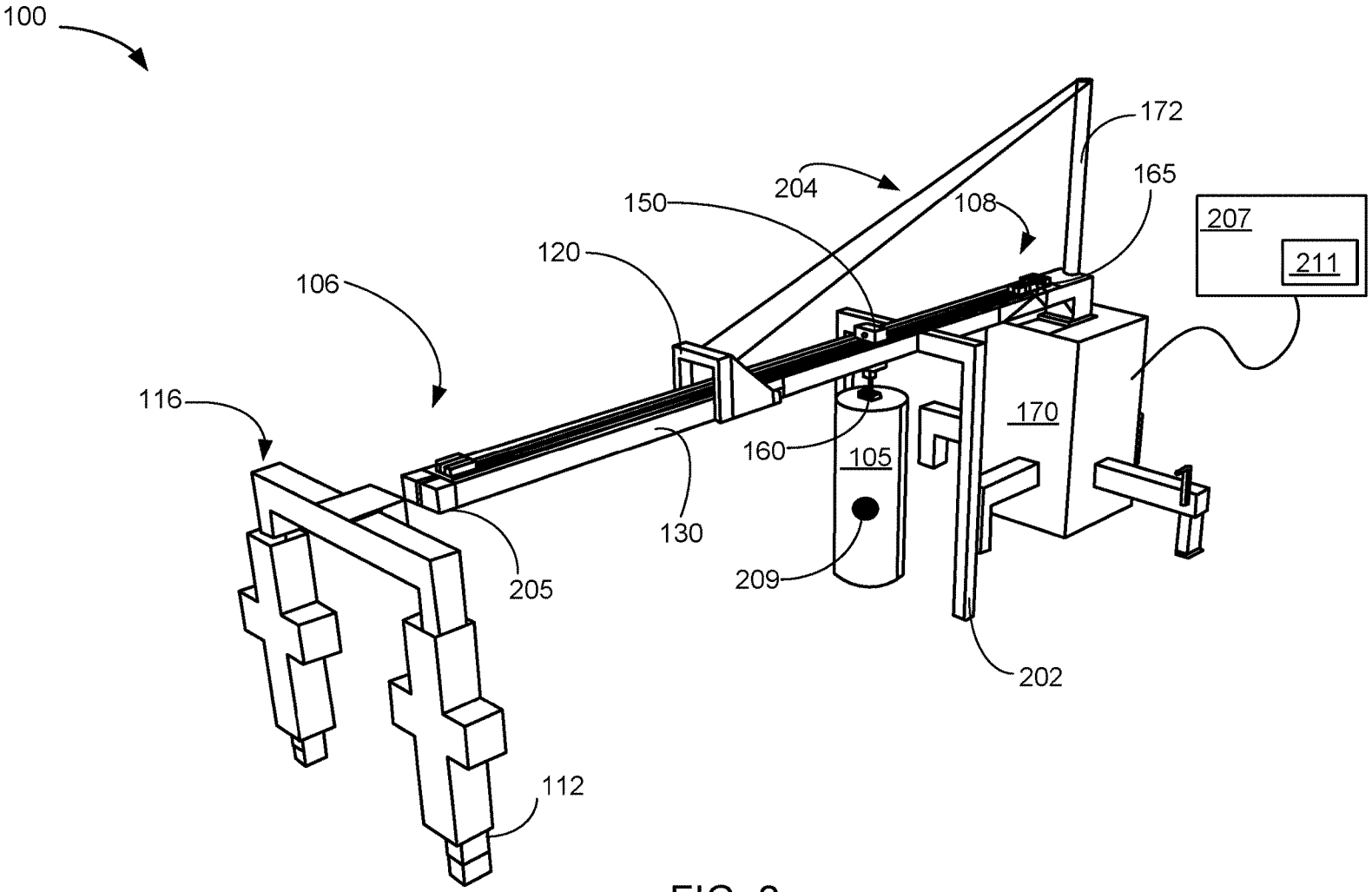
FIG. 2 is an offset top view of the sports training safety system of FIG. 1.

Referring now to FIG. 2, therein is shown an offset top view of the sports training safety system 100 of FIG. 1. The offset top view can include a detailed view of the support frame 120 and the boom support 172.

The offset top view can also include hub side frame legs 202. The hub side frame legs 202 provide additional stability and support for the delivery rail 130 at the hub side 108. The hub side frame legs 202 can be optional and be attached and detached from the delivery rail 130.

The offset top view can include a support cable 204 attached from the support frame 120 to the boom support 172 for holding up the end frame side 106 of the delivery rail 130. The support cable 204 can include a single cable, double cable, or multiple cable configuration.

For example, the support frame 120 can include one or more cables to ensure the stability of the end frame side 106 of the delivery rail 130. The support frame 120 can be attached or anchored to a high point on the boom support 172 for suspending the delivery rail 130 off the ground.

The support frame 120 can be attached to the lateral sidewalls of the delivery rail 130 leaving clearance space for the delivery carriage 150 to move along the top side of the delivery rail 130. The support frame 120 can slide toward the end frame side 106 of the delivery rail 130 when the modular delivery rail support frame 116 is removed.

The sports training safety system 100 can include a controller 207, which is a device for operating, controlling, and programing the transport system 165 and the release of the training dummy 105. The controller 207 can include hardware, software, or a combination thereof such as a computer system.

The controller 207 can be housed in the center hub 170 and can include displays and input devices mounted on the center hub 170. The controller 207 can also be stored on a remote computer or device and use a wireless connection for operating the transport system 165.

The controller 207 can also operate and display the controls for analog sensors, gyroscopes, cameras, and proximity sensor of the sensor 107 of FIG. 1. The controller 207 can be used to program the operation of the transport system 165, such as moving the training dummy 105 to specific locations along the delivery rail 130. It has been discovered that the controller 207 can be used to operate and program the movement and travel patterns of the training dummy 105 to mimic real life and different situations to improve muscle memory and facilitate training The sensors equipped on the sports training safety system 100 can detect a contact event 209. The contact event 209 is an impact, such as a user striking or hitting the training dummy 105. The controller 207 can stop the motion of the delivery carriage 150 in the event that the contact event 209 is detected. The contact event 209 can also be used to release the training dummy 105 from the magnetic release 160.

The controller 207 can collect and display feedback information 211. The feedback information 211 is data that can include biomechanical information and kinesiological information based on the contact event 209 and the user's motion while using the sports training safety system 100. The feedback information 211 can be collected by the sensor 107 of FIG. 1.

It has been found that the modular delivery rail support frame 116 can be removed to allow more free space for open field tackling. Users can approach the training dummy 105 at different approach angles and do not have the risk of running into the end fame legs 112 because the end frame side 106 of the delivery rail 130 is supported by the support frame 120 and the boom support 172.

The modular delivery rail support frame 116 can include end frame bolts 205 for attaching and detaching the modular delivery rail support frame 116 and the end frame legs 112 from the delivery rail 130. The end frame bolts 205 allow for maximum tackling drill flexibility by allowing quick attachment and removal of the modular delivery rail support frame 116. The hub side frame legs 202 can be used for additional support of the frame 102 of FIG. 1, when the modular delivery rail support frame 116 is removed.

Figure 3:
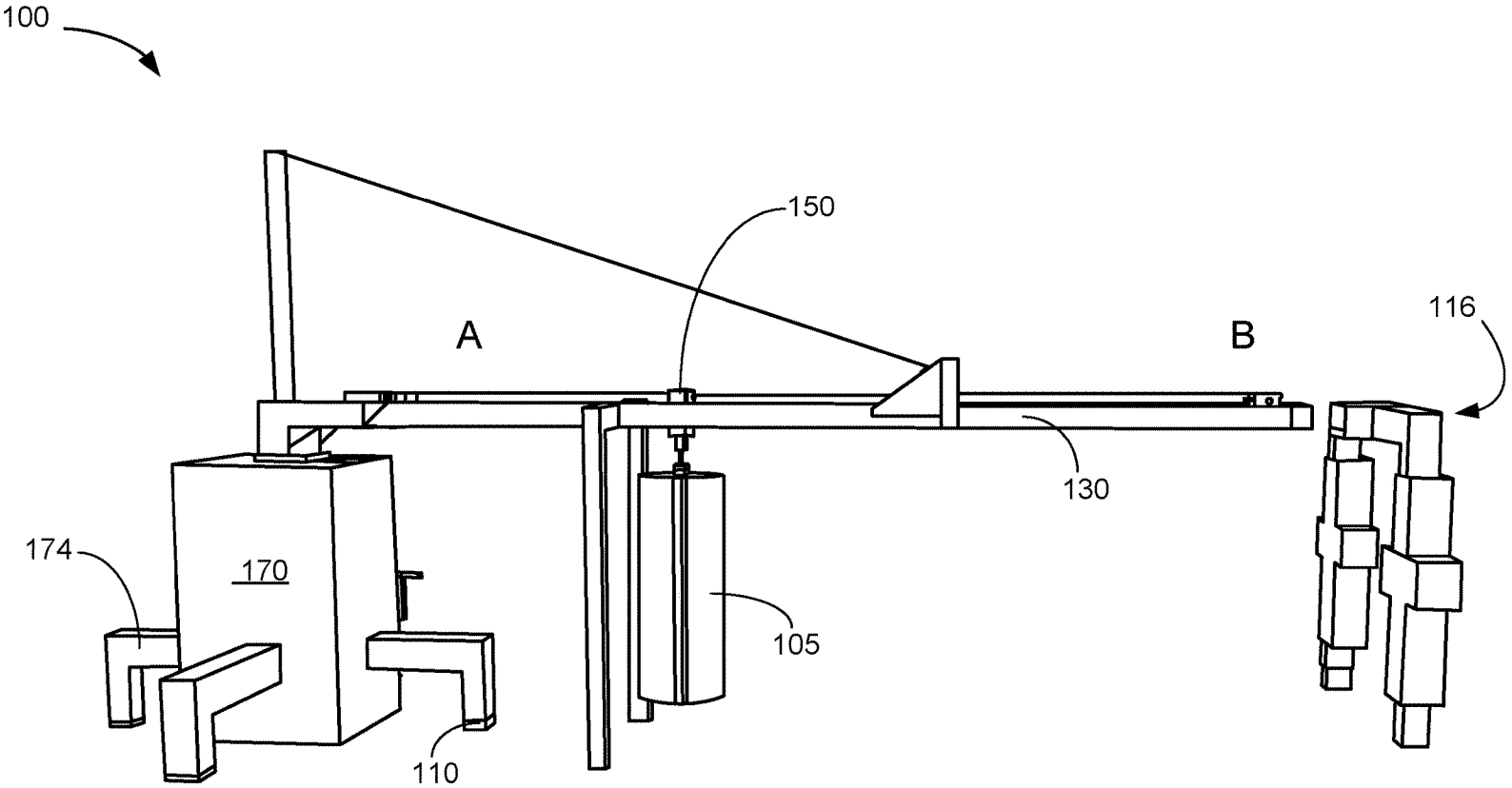
FIG. 3 is a side view of the sports training safety system of FIG. 1.

Referring now to FIG. 3, therein is shown a side view of the sports training safety system 100 of FIG. 1. The caster system 110 can be attached to the base of each of the center hub support 174 and optionally to the base of the center hub 170.

The caster system 110 allows for 360 degree mobility of the sports training safety system 100 on the ground, which allows for flexibility in setup on the field. It has been found that the modular delivery rail support frame 116 can be removed to allow more free space for open field tackling and use of the system.

The delivery carriage 150 and the training dummy 105 can move from position "A" to position "B". For illustrative purposes, the movement from position A to position B is associated with forward and back movement on the delivery rail 130. The delivery carriage 150 and the training dummy 105 can be moved and stopped at any position between position A and position B.

Further, the delivery carriage 150 and the training dummy 105 can start at position B and move to position A. Users of the sports training safety system 100 can use the system by chasing the training dummy 105 and completing a tackle at position A. It has been found that the sports training safety system 100 can mimic a retreating opponent by moving the training dummy 105 from position B to position A. For example, the training dummy 105 can model a retreating quarterback in a real sporting event situation.

Figure 4:
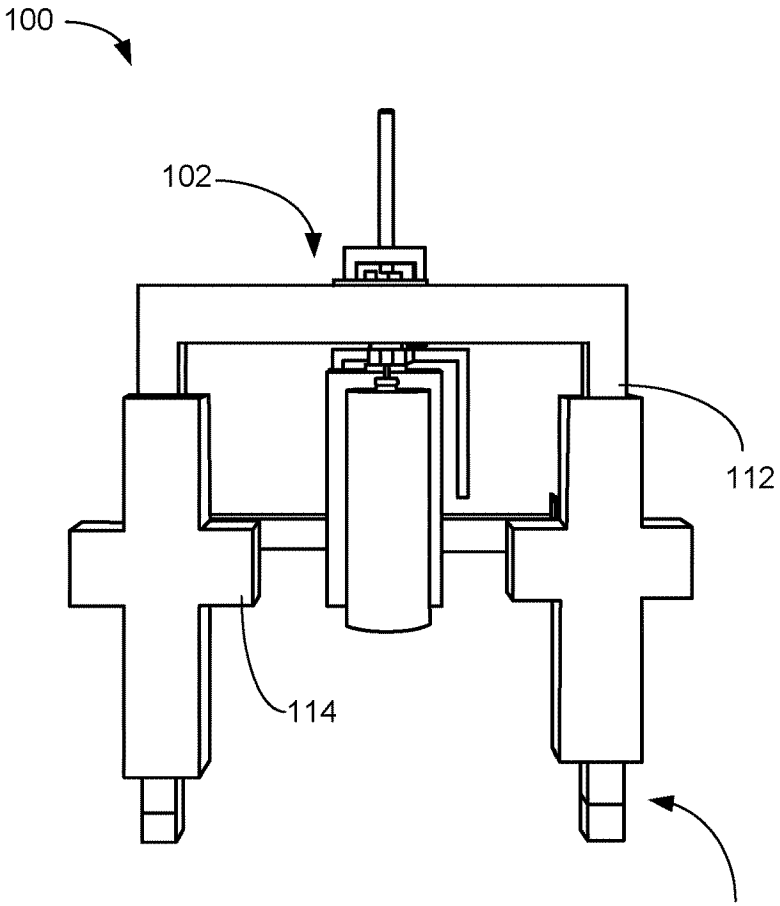
FIG. 4 is an example end view of the sports training safety system of FIG. 1.

Referring now to FIG. 4, therein is shown an example end view of the sports training safety system 100 of FIG. 1. The end view shows the perspective of a user standing at the end frame side 106 of FIG. 1 of the frame 102, which is opposite to the apparatus hub 104 of FIG. 1.

The example end view can show example dimensions of the frame 102 and the end frame legs 112. The end frame legs 112 can include a distance of six to ten feet between the two interior facing sides of each leg or between a side of a leg facing a mirrored side of a second leg.

The end frame hand shield 114 can include a separation of four feet from the closest lateral parts of the left hand shield and the right hand shield. It has been found that the height of the frame 102 can be adjusted to allow a user to safety train on the dummy suspended from the delivery rail 130 of FIG. 1.

Figure 5:
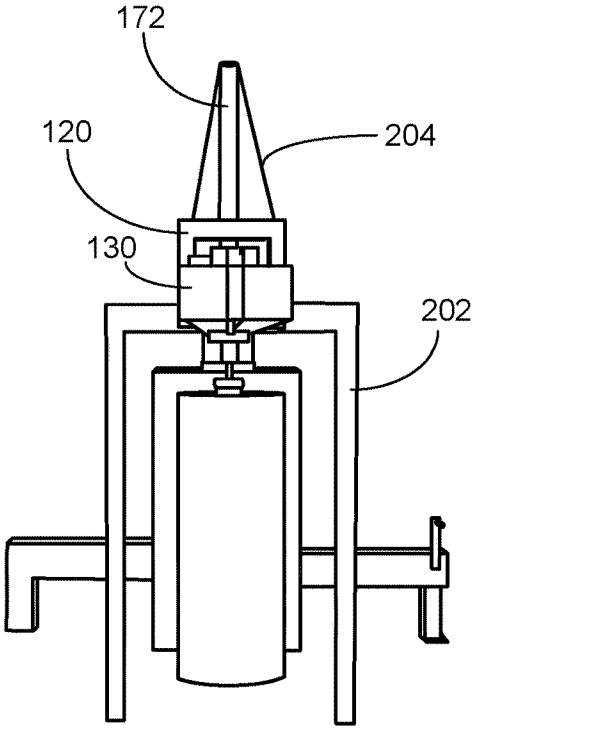
FIG. 5 is a second end view of the sports training safety system of FIG. 1.

Referring now to FIG. 5, therein is shown a second end view of the sports training safety system 100 of FIG. 1. The second end view can show the hub side frame legs 202 and shows the modular delivery rail support frame 116 of FIG. 1 removed.

The second end view also shows the support cable 204 attached to the support frame 120 and the boom support 172. The delivery rail 130 is anchor to the boom support 172 for suspending the end frame side 106 of FIG. 1 of the delivery rail 130 above the ground. It has been found that the hub side frame legs 202 provide additional stability to the sports training safety system 100 in this configuration.

Figure 6:
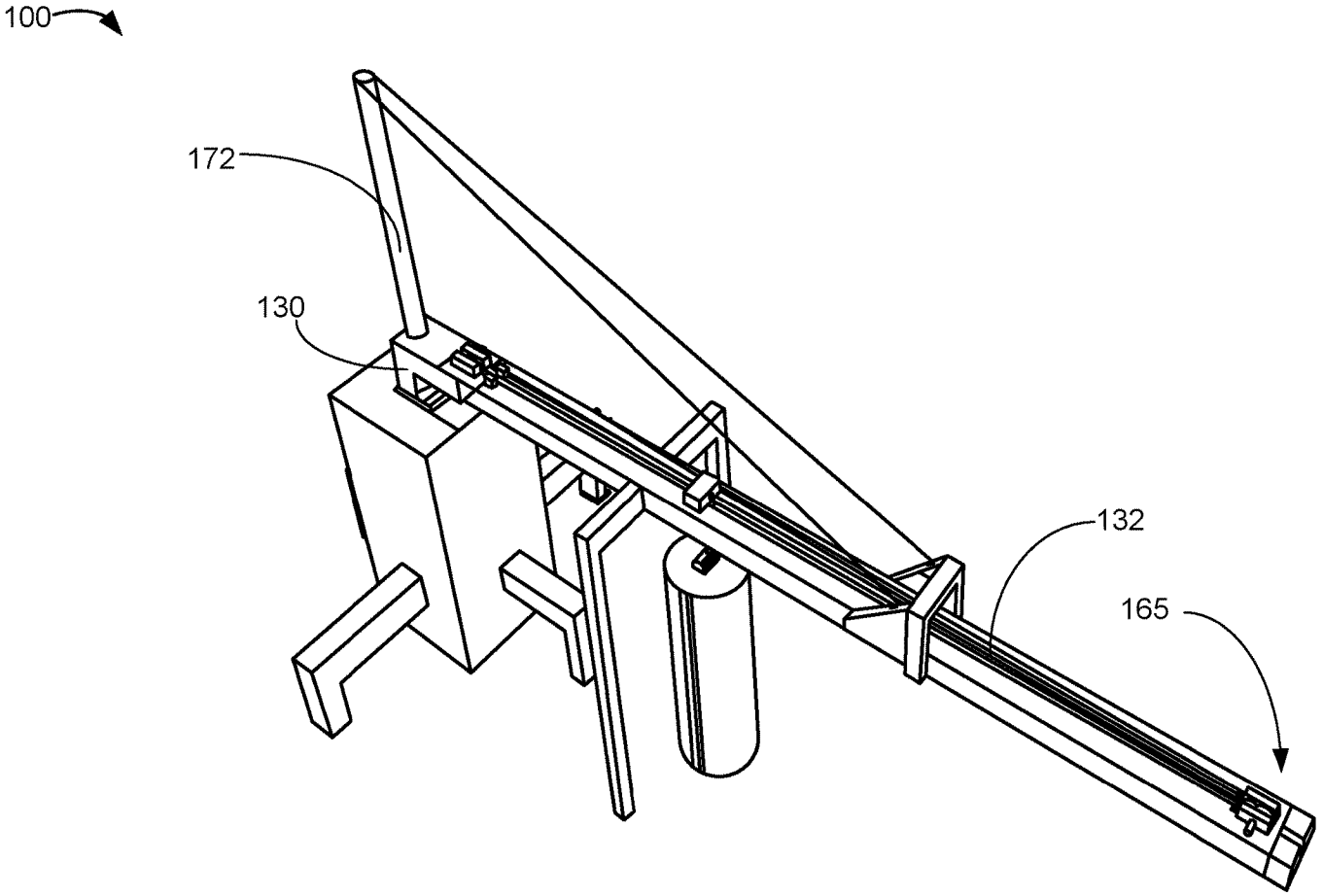
FIG. 6 is a second off-set top view of the sports training safety system of FIG. 1.

Referring now to FIG. 6, therein is shown a second off-set top view of the sports training safety system 100 of FIG. 1. The second end view shows the modular delivery rail support frame 116 of FIG. 1 removed.

The transport system 165 is shown in a single cable configuration. However, the transport system 165 can include a multiple cable configuration and a circular track configuration. The cable delivery 132 can include wires, cables, or chains. The boom support 172 is shown attached to and extending through the delivery rail 130.

Figure 7:
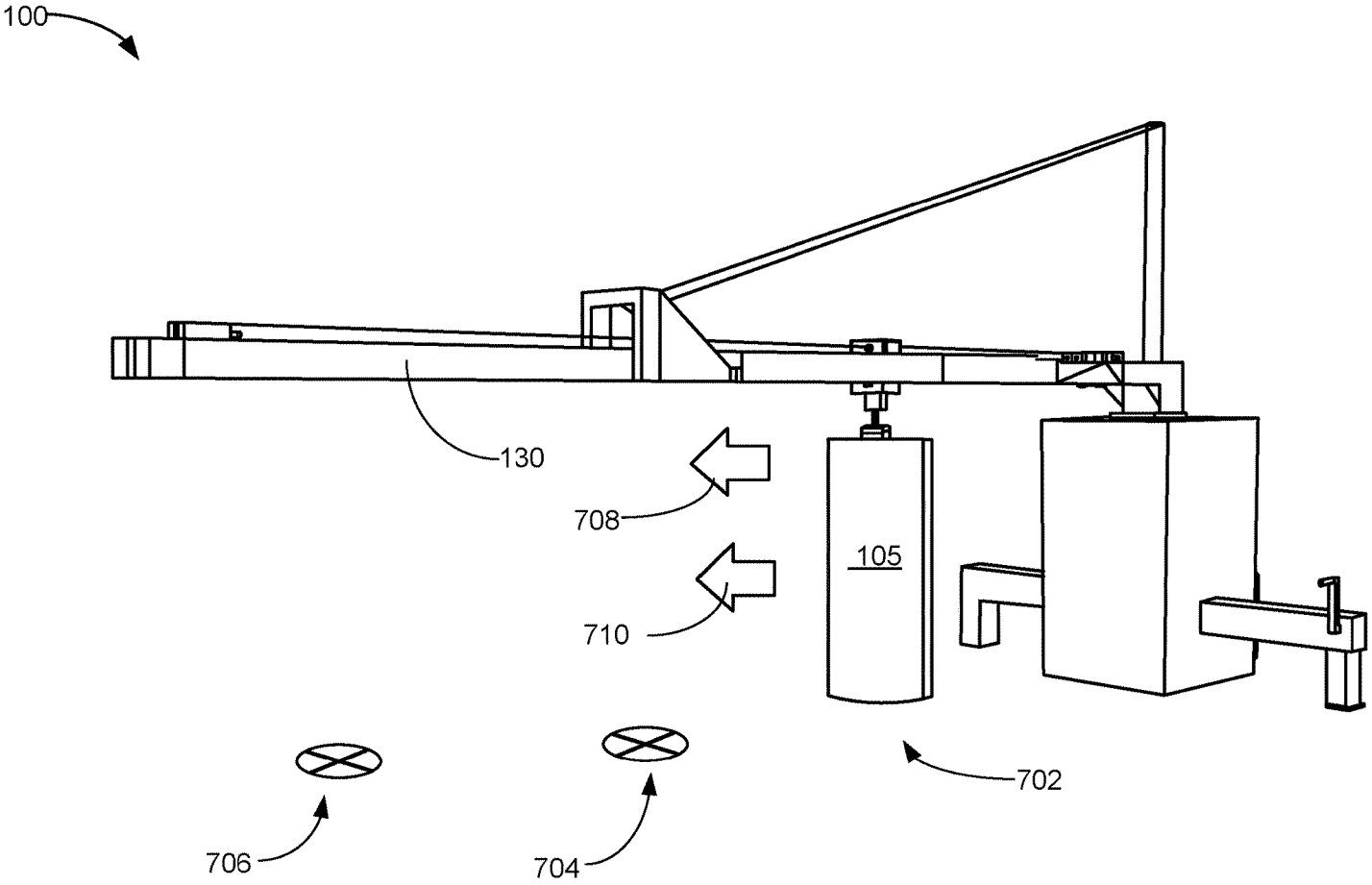
FIG. 7 is a second isometric view of the sports training safety system of FIG. 1.

Referring now to FIG. 7, therein is shown a second isometric view of the sports training safety system 100 of FIG. 1. The second view shows the modular delivery rail support frame 116 of FIG. 1 removed. The second view also shows the hub side frame legs 202 of FIG. 2 removed from the delivery rail 130.

The second isometric view can include a start location 702, a first target location 704, and a second target location 706. For illustrative purposes, the first target location 704 and the second target location 706 are indicated by a circular target symbol. The start location 702, the first target location 704, and the second target location 706 are example stop locations for the training dummy 105.

The start location 702, the first target location 704, and the second target location 706 can be pre-selected by a user and can be mapped to any location along the delivery rail 130. For example, an operator of the system can user the controller 207 of FIG. 2 to program or set the first target location 704. Further for example, the start location 702 can be programed to be at the position B, shown in FIG. 3. The first target location 704 can also be programed to be at position A, shown in FIG. 3.

Based on real-time operation or programing, the sports training safety system 100 can move the training dummy 105 to the pre-selected location, such as the first target location 704. The operator of the system can also control a carriage speed 708 of the delivery carriage 150 and a carriage acceleration 710 of the delivery carriage 150. For illustrative purposes, the motion, speed, and acceleration of the delivery carriage 150 and the training dummy 105 can be indicated by arrows.

The sports training safety system 100 can also be programed to release the training dummy 105 at any location along the delivery rail 130. For example, the training dummy 105 can automatically be released at the second target location 706 at position B as shown in FIG. 3. It has been found that automatically releasing the training dummy 105 at a stopping location, such as the first target location 704 can prevent wear and tear to the frame 102 of FIG. 1. This prevents the training dummy 105 from swinging at a stop location, which can also harm people within range.

The carriage speed 708 and the carriage acceleration 710 can be modified and adjusted during operation of the sports training safety system 100. The carriage speed 708 and the carriage acceleration 710 can also be programed to change at any point during movement along the delivery rail 130.

For example, acceleration and speed of the training dummy 105 can be increased or decreased from the first target location 704 to the second target location 706. It has been found that the sports training safety system 100 can be programed to mimic random movements that represent the movements of a human opponent as human opponents can adjust their speed and acceleration in preparation to avoid tackles in live sporting events.

The travel path of the training dummy 105 can be programed to include a set pattern and a set timing. For example, the training dummy 105 can travel to the first target location 704, pause, and then accelerate to the second target location 706. It has been found that the delivery rail 130, the transport system 165, the delivery carriage 150, and the controller 207 can be used to program pre-set paths, travel paths, and training drills for athletes to practice different game time scenarios.

It has been discovered that the delivery rail 130, the transport system 165, the delivery carriage 150, and the controller 207 can be used to modify the stop locations, the carriage speed 708, and the carriage acceleration 710 of the delivery carriage 150. The control and programing of the sports training safety system 100 allows for a sports system that can mimic real-life sports conditions.

Figure 8:
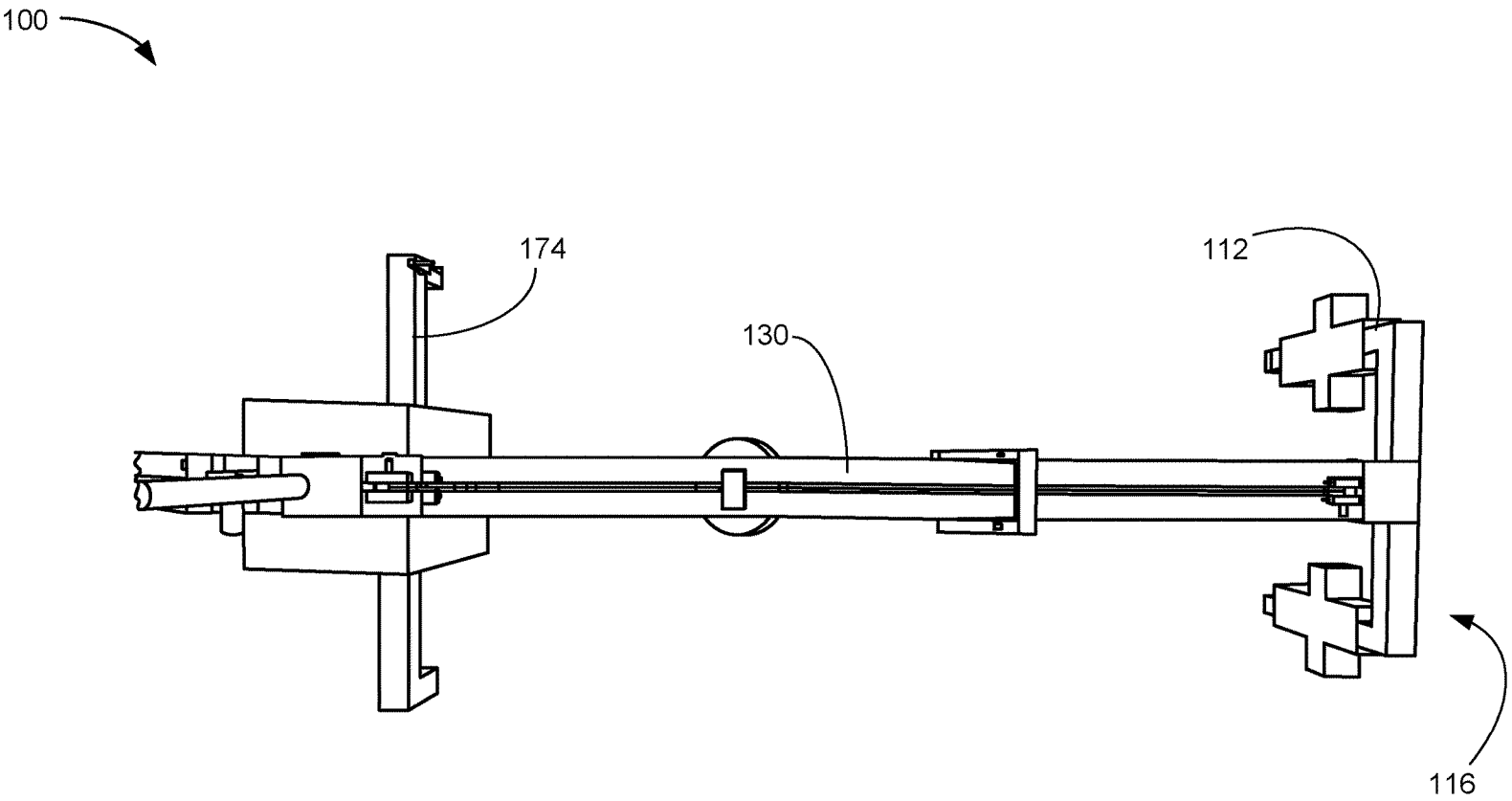
FIG. 8 is a top view of the sports training safety system of FIG. 1.

Referring now to FIG. 8, therein is shown a top view of the sports training safety system 100 of FIG. 1. The top view shows the modular delivery rail support frame 116 attached to the delivery rail 130.

The length of the delivery rail 130, which includes the distance between a leg of the center hub support 174 to one of the end frame legs 112. The length of the delivery rail can be forty feet. It has been found that the delivery rail 130 including a distance of more than ten yards can provide a training experience that mimics real game conditions for executing contact drills in a wide-open space.

Figure 9:
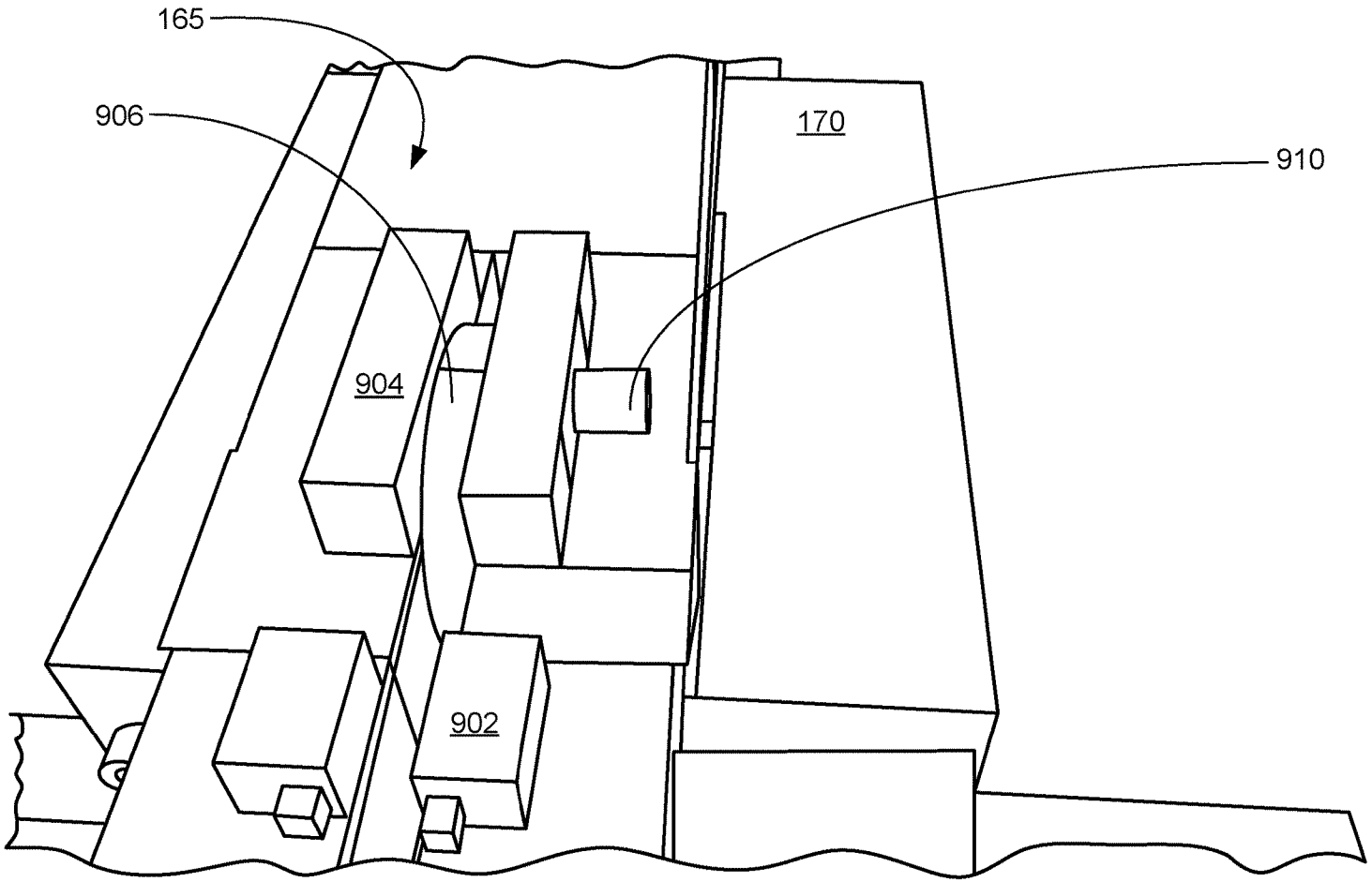
FIG. 9 is an example detailed view of the transport system.

Referring now to FIG. 9, therein is shown an example detailed view of the transport system 165. The example includes a motorized pulley wheel delivery assembly as the engine for moving the delivery carriage 150 of FIG. 1. The transport system 165 can be mounted on the top of the center hub 170. The transport system 165 includes a drive wheel 906, a wheel mount 904, and a pulley wheel motor 910. The cable delivery 132 of FIG. 1 can extend from the drive wheel 906 and feed through a carriage stop 902.

The drive wheel 906 sits in the wheel mount 904, allowing the drive wheel 906 to turn and move the cable delivery 132. The cable delivery 132 is attached to the delivery carriage 150 for moving the delivery carriage 150 and the training dummy 105 of FIG. 1 along the delivery rail 130 of FIG. 1. A carriage stop 902 can be mounted on the delivery rail 130 to prevent the delivery carriage 150 from damaging the transport system 165.

The pulley wheel motor 910 is attached to the wheel mount 904. The pulley wheel motor 910 includes adjustable velocity with throttle control, which allows the training dummy 105 to travel at different speeds and to change accelerations to mirror human opponents during real sporting game conditions.

Figure 10:
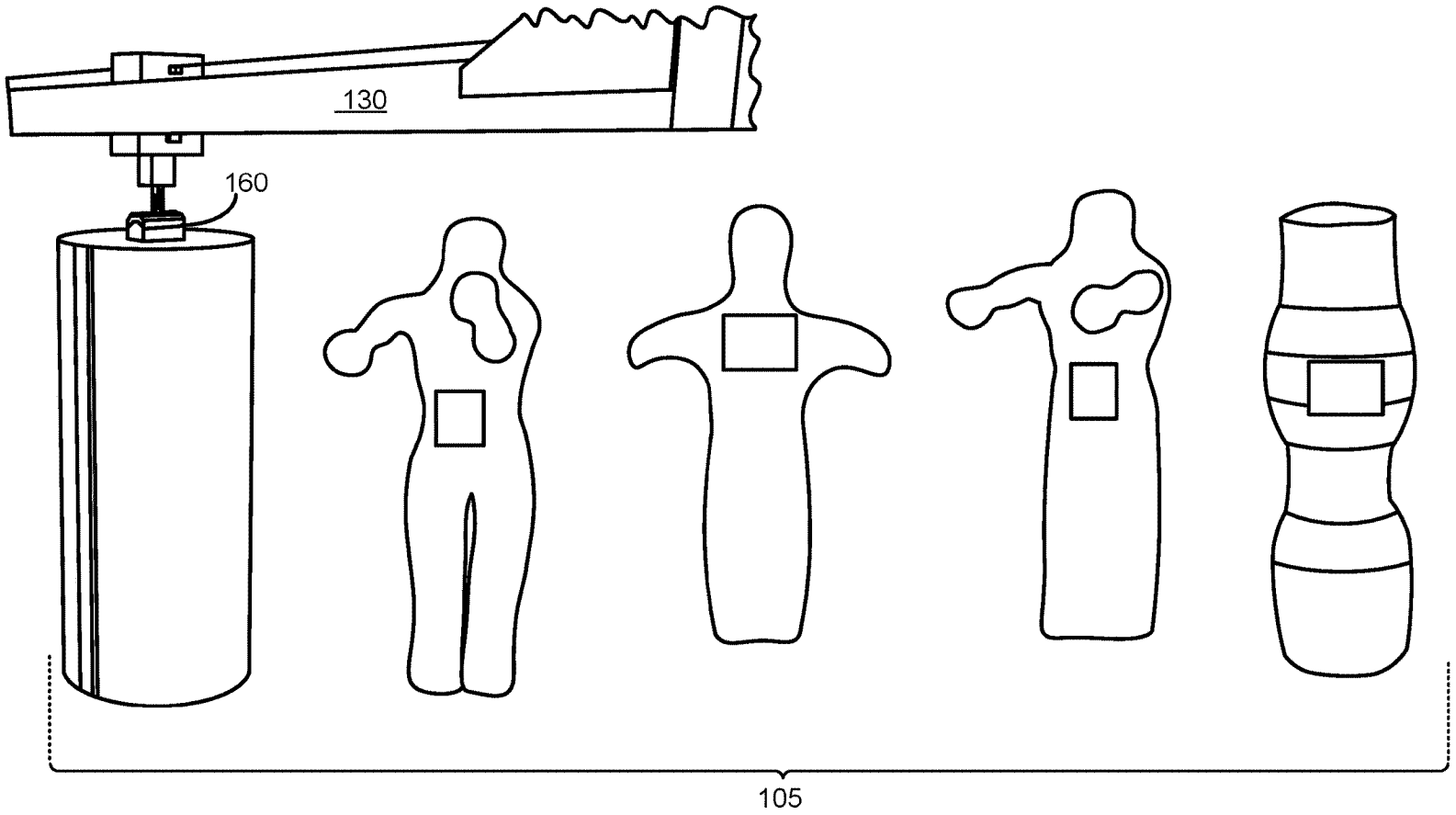
FIG. 10 is example views of the training dummy

Referring now to FIG. 10, therein is shown example views of the training dummy 105. The example views include a plurality of different types of the training dummy 105. The training dummy 105 can include a tackling dummy, weighted pad, ball, or target.

The training dummy 105 is suspended from the delivery rail 130 by the magnetic release 160. It has been found that the training dummy 105 can be suspended off the ground approximately eighteen inches for safe and obstruction-free clearance off the ground.

For example, the different types of the training dummy 105 can include a cylinder dummy bag, a legged grappling dummy, a spread arm grappling bag, a forward extended arm grappling bag, and a throw bag. It has been found that the various different types of dummies for the training dummy 105 provides for different techniques and tackling angles to be practiced as the training dummy 105 moves along the delivery rail 130.

The training dummy 105 can include different weight options. For example, the training dummy can include a fifteen pound bag, a twenty-five pound bag, a fifty-pound bag, a seventy-five pound bag, and a one hundred pound bag. It has been found that the magnetic release 160 has support strength for carrying and releasing a wide variety of the training dummy 105. For example, the training dummy 105 can include a weight of one hundred pound or more.

It has been discovered that the sports training safety system 100 of FIG. 1 can include the training dummy 105 having a modular and interchangeable attachment system. For example, the training dummy 105 can include quick attachment and detachment of various types of dummies for practicing different tackling angles and athletic actions.

Figure 11:
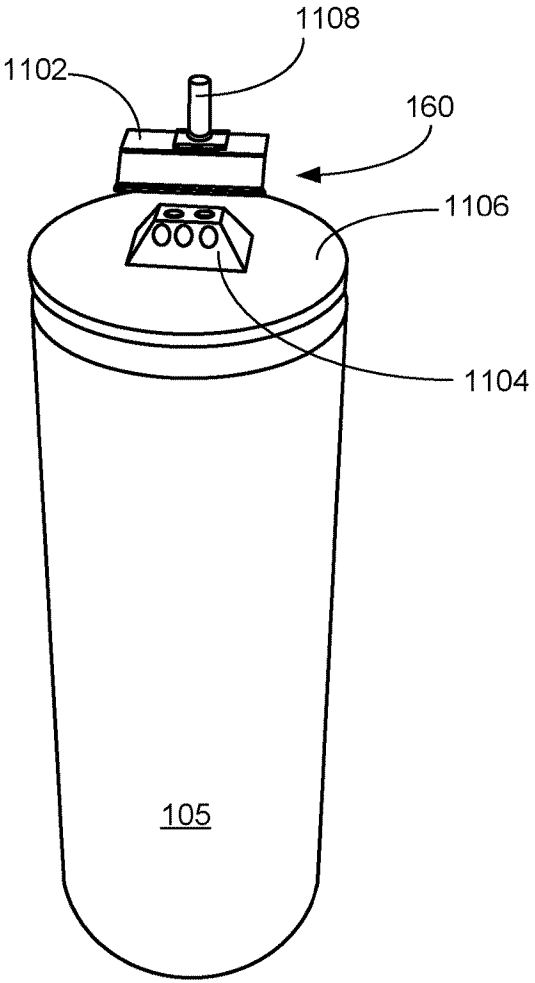
FIG. 11 is a detailed view of the training dummy and the magnetic release of the sports training safety system of FIG. 1.

Referring now to FIG. 11, therein is shown a detailed view of the training dummy 105 and the magnetic release 160 of the sports training safety system 100 of FIG. 1. The magnetic release 160 can include a metal bracket 1102. The training dummy 105 can include a mounting magnet 1104.

The metal bracket 1102 is attached to the delivery carriage 150 of FIG. 1 by a rod connector 1108. The rod connector 1108 can include a rod, post, pillar, or other weight bearing structure. It has been found that the rod connector 1108 can be detached from the metal bracket 1102, other brackets, and connector types, such that the rod connector 1108 can be compatible with interchangeable bracket types.

The metal bracket 1102 serves as the detach point for the training dummy 105. The training dummy 105 includes the mounting magnet 1104, which is attached thereon and not intended to be detached from the training dummy 105 during operation of the sports training safety system 100.

The training dummy 105 can include a mounting plate 1106, which can be sewn onto the training dummy 105. The mounting magnet 1104 can be attached to the mounting plate 1106. The mounting magnet 1104 includes a number of magnets that are determined by the weight of the training dummy 105 or training bag.

It has been found that the magnetic release 160 allows the release of the training dummy 105 to occur easily, controllably, and predictably from the apparatus. The training dummy 105 can be suspended from the metal bracket 1102 by a single point of magnetic contact to a steel plate on the top of the training dummy 105. It has been found that since the training dummy 105 can be completely tackled to the ground, this configuration and set up provides a more realistic and safer tackling experience for the athlete.

Figure 12:
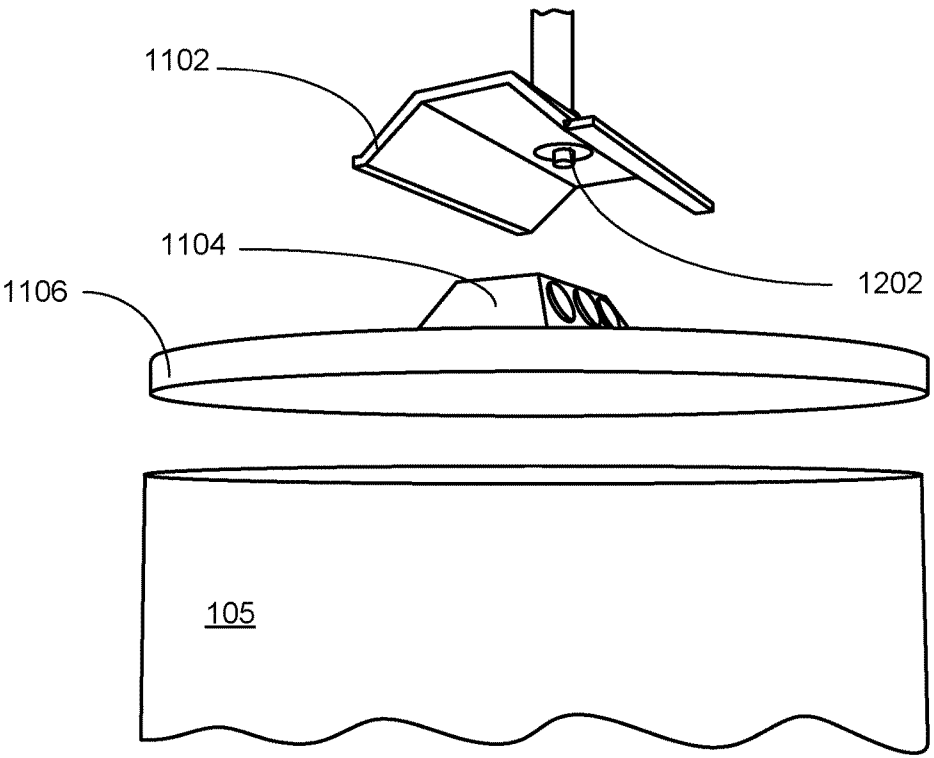
FIG. 12 is a detailed view of the metal bracket, the mounting magnet, and the mounting plate.

Referring now to FIG. 12, therein is shown a detailed view of the metal bracket 1102, the mounting magnet 1104, and the mounting plate 1106. The metal bracket 1102 can include a switch 1202.

The switch 1202 is used to detect the removal of the training dummy 105. The switch 1202 can send a signal to the motor of the sports training safety system 100 of FIG. 1 when the training dummy 105 is connected.

It has been found that the switch 1202 can signal to the sports training safety system 100 to stop the delivery carriage 150, after the training dummy 105 has been removed or tackled from the sports training safety system 100.

The switch 1202 can include a mechanical or electrical mechanism for triggering the detachment of the training dummy 105. The switch 1202 can be located on the bottom surface of the metal bracket 1102. The switch 1202 can include a push type switch.

For illustrative purposes, the mounting plate 1106 and the mounting magnet 1104 are shown detached from the training dummy 105. It has been found that the mounting plate 1106 and the mounting magnet 1104 can be interchangeable with the training dummy 105, allowing a magnetic or electromagnetic connector to be installed on the training dummy 105.

Figure 13:
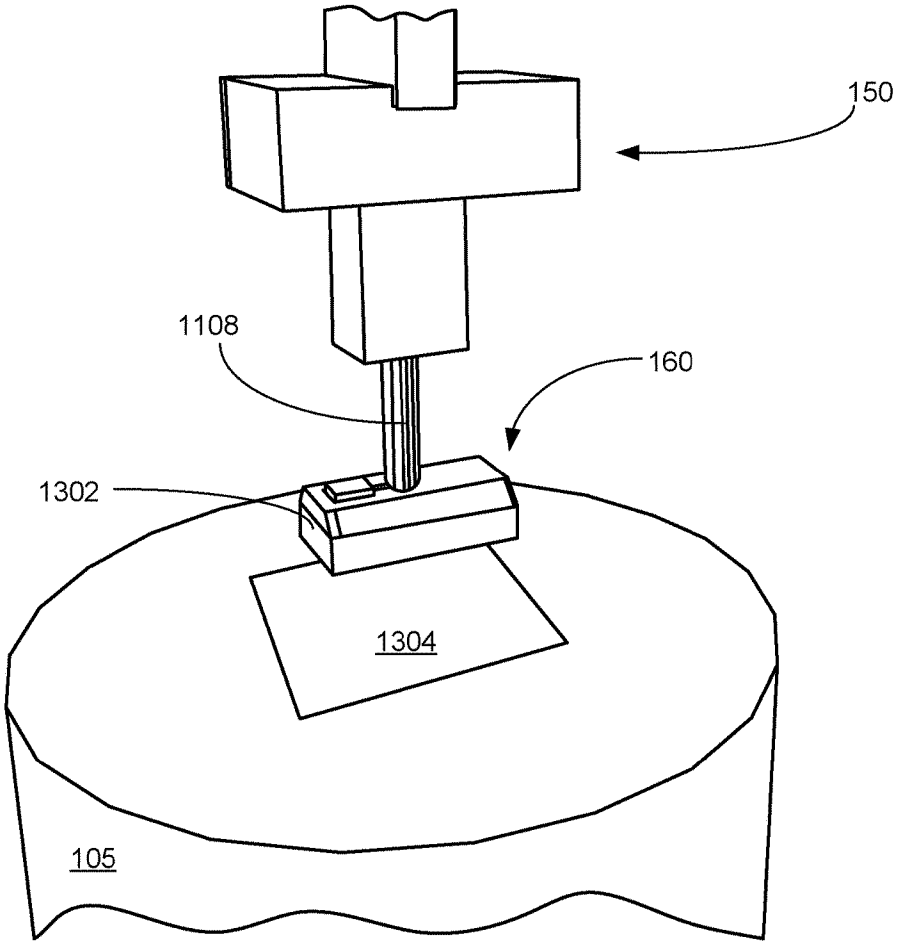
FIG. 13 is a detailed view of the training dummy and the magnetic release in a second embodiment of the present invention.

Referring now to FIG. 13, therein is shown a detailed view of the training dummy 105 and the magnetic release 160 in a second embodiment of the present invention. The magnetic release 160 is show as a device using an electromagnet 1302 and a metal connector plate 1304 to control the release of the training dummy 105.

The detailed view also includes the delivery carriage 150 and the rod connector 1108. The rod connector 1108 extends from the delivery carriage 150 for attaching the magnetic release 160 to the delivery carriage 150.

The electromagnet 1302 is device including a piece of metal that becomes magnetic when an electric current is passed through or near it. The electromagnet 1302 can include one or more electromagnets for adjusting the strength of the magnetic connection. The electromagnet 1302 can be controlled by current and the strength of the electromagnet 1302 can be adjusted by increased power output and the number of electromagnets installed. The power source for the electromagnet 1302 can be housed in the apparatus hub 104 of FIG. 1.

The electromagnet 1302 can be attached to the metal connector plate 1304, which controls the attachment and detachment of the training dummy 105. The metal connector plate 1304 can be mounted or sewn onto the training dummy 105.

The electromagnet 1302 can be manually or automatically disengaged for releasing the training dummy 105. For example, an operator of the system can disengage the power to the electromagnet 1302 at any time during operation. Further, the electromagnet 1302 can be disengaged based on the sensor 107 of FIG. 1. For example, if the sensor 107 detects impact to the training dummy 105, the electromagnet 1302 can be immediately disengaged for allowing the training dummy 105 to fall to the ground.

Further, it has been found that the electromagnet 1302 can produce resistive force in removing the training dummy 105 from the magnetic release 160. In this configuration, a user must apply enough physical force to dislodge the training dummy 105 by overcoming the hold produced by the electromagnet 1302. The hold can be adjusted by the user when operating the system. This option allows users to do strength-training exercises during tackling practice.

The training dummy 105 can also be released based on a stop location, such as the first target location 704 of FIG. 7 or the second target location 706 of FIG. 7. For example, the electromagnet 1302 can be disengaged automatically when the training dummy 105 reaches the second target location 706. It has been found that the automatic release of the training dummy 105 prevents wear and tear to the frame 102 of FIG. 1, which can be caused by the weight of the training dummy 105 coming to a quick stop.

It has been discovered that the electromagnet 1302 and the sensor 107 provides for detachment of the training dummy 105 from the magnetic release 160 either by way of the contact event 209 of FIG. 2 or other user preference, such as location. For example, the training dummy 105 can be programmed to be released when the delivery carriage 150 reaches a specific point on the delivery rail 130.

The electromagnet 1302 and the sensor 107 allow the release of the training dummy 105 to occur easily, controllably, and predictably from the apparatus. The training dummy 105 is suspended from the overhead rail by a single point of magnetic contact to a steel plate on the top of the tackling dummy. It has been found that since the training dummy 105 can be completely tackled to the ground, this configuration and set up provides a more realistic and safer tackling experience for the athlete.

Figure 14:
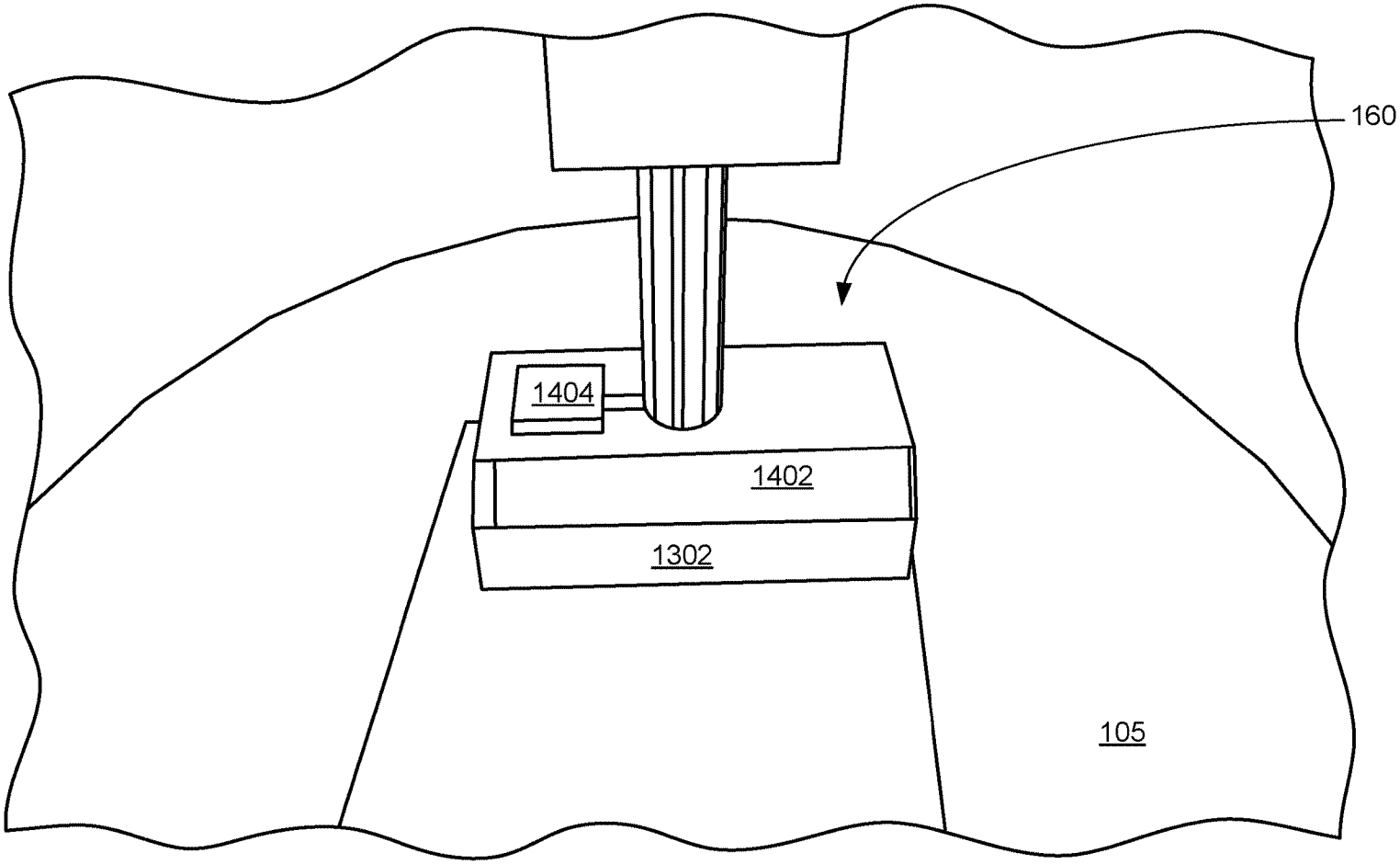
FIG. 14 is a partial detailed view of the structure of FIG. 13.

Referring now to FIG. 14, therein is shown a partial detailed view of the structure of FIG. 13. The detailed view shows the magnetic release 160 including a mounting bracket 1402 and a controller module 1404.

The mounting bracket 1402 can house the electromagnet 1302. The mounting bracket 1402 can store electrical wiring needed by the electromagnet 1302 for operation. Further, the mounting bracket 1402 can optionally house a power source for powering the electromagnet 1302.

The controller module 1404 is a device that is mounted to the electromagnet 1302. The controller module 1404 can include a power system and control ribbon to the motor controller. The module can also include a power management brick.

The controller module 1404 can also include motion sensors, accelerometers, inertial sensor, gyroscopes, analog circuitry, for motion sensing and contact position data collection.

The controller module 1404 can include motion sensors such as accelerometers, inertial sensors, and gyroscope as examples in addition to the sensor 107 of FIG. 1. The controller module 1404 can include an encoder for monitoring the position of the training dummy 105 on the delivery rail 130 of FIG. 1. It has been discovered that the controller module 1404 having the encoder can pinpoint the position of the training dummy 105 at any point on the delivery rail 130, which allows for precise control of the delivery carriage 150 of FIG. 1.

Figure 15:
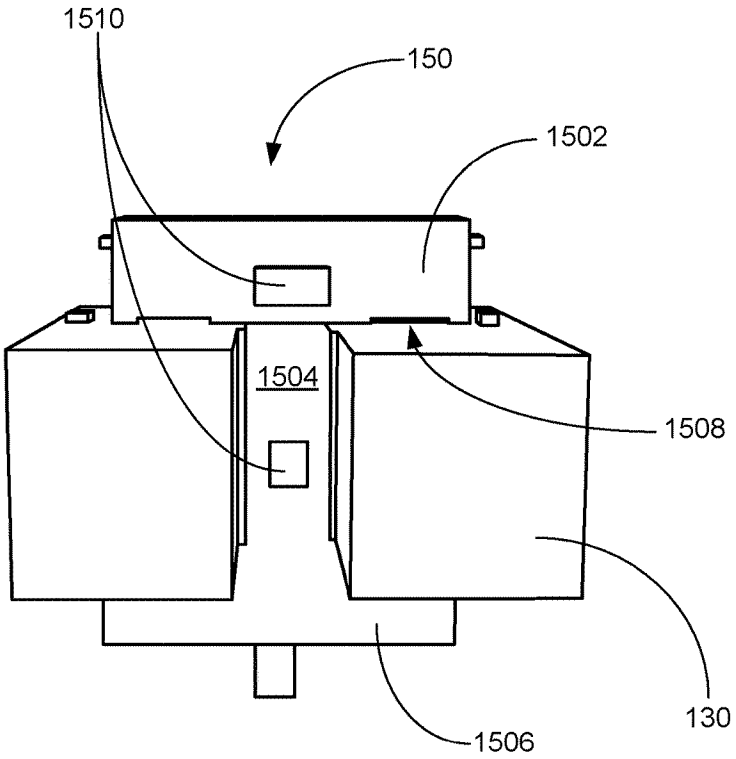
FIG. 15 is a detailed view of the delivery carriage and the delivery rail.

Referring now to FIG. 15, therein is shown a detailed view of the delivery carriage 150 and the delivery rail 130. The detailed view is a cross-sectional view through the delivery rail 130 taken from the perspective of the end frame side of FIG. 1. The delivery rail 130 can include two parallel rails suspended off the ground. The delivery rail 130 can include a top side, an inner lateral side, and a bottom side.

The delivery carriage 150 can include a top anchor 1502, an anchor shaft 1504, and a bottom anchor 1506. The top anchor 1502, the anchor shaft 1504, and the bottom anchor 1506 form an uppercase "I" shape between the two parallel rails of the delivery rail 130.

The top anchor 1502 is supported by the top side of both the rails of the delivery rail 130. The anchor shaft 1504 extends from the top anchor 1502 and is between the rails of the delivery rail 130. The sidewalls of the anchor shaft 1504 are in direct contact with the inner lateral sides of both rails of the delivery rail 130.

The bottom anchor 1506 is directly attached to the bottom portion of the anchor shaft 1504. The bottom anchor 1506 is in direct contact with the bottom side of both rails of the delivery rail 130.

The delivery carriage 150 can also include a set of carriage wheels 1508 for moving the delivery carriage 150 along the delivery rail 130. The carriage wheels 1508 can be mounted at each of the surfaces of where the delivery carriage 150 touches the delivery rail 130.

For example, the top anchor 1502 can include four wheels, which are in direct contact with the top side of both rails of the delivery rail 130. The anchor shaft 1504 can include wheels on both lateral sidewalls of the anchor shaft 1504.

The carriage wheels 1508 can also be mounted on the bottom anchor 1506 and can be in direct contact with the bottom side of both rails of the delivery rail 130. For example, the carriage wheels 1508 can include sixteen wheels to ensure a smooth delivery.

The carriage wheels 1508 can also be configured to include shock absorption for movement along the delivery rail 130. The delivery carriage 150 can also include a cable mount 1510. The cable mount 1510 can be used to attach the cable delivery 132 of FIG. 1 to the delivery carriage 150.

Figure 16:
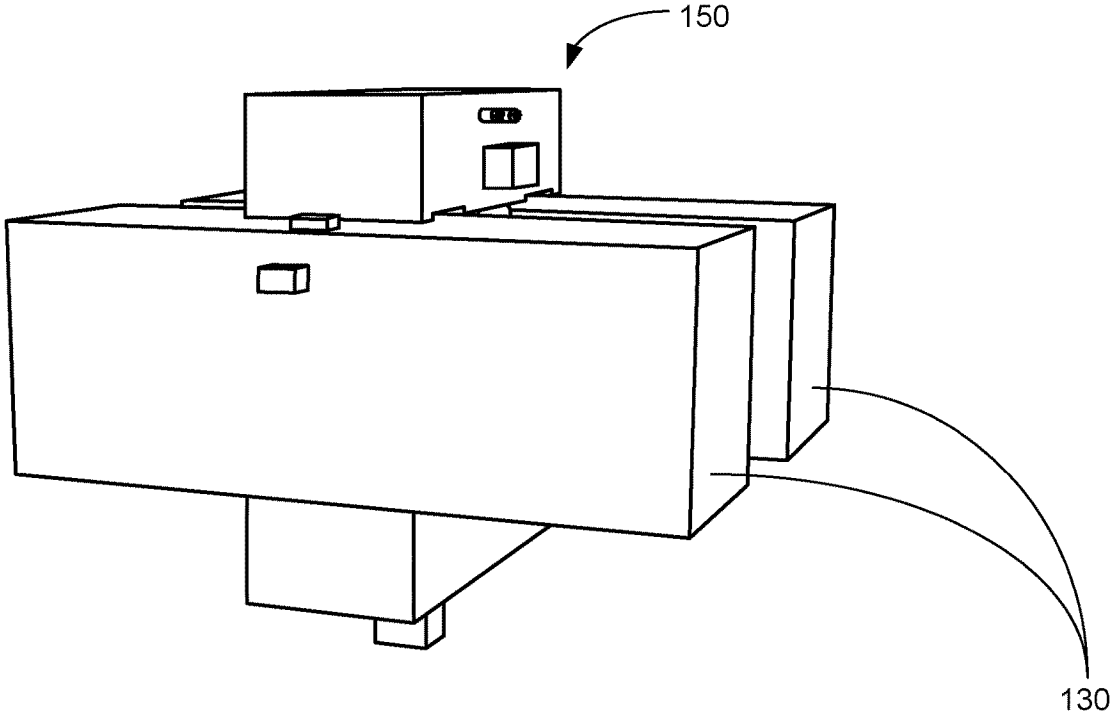
FIG. 16 is a detailed isometric view of the delivery carriage and the delivery rail.

Referring now to FIG. 16, therein is shown a detailed isometric view of the delivery carriage 150 and the delivery rail 130. The detail view shows the delivery carriage 150 in-between the delivery rail 130. The delivery rail 130 can support the delivery carriage 150 as it moves forward and back along the delivery rail 130.

Figure 17:
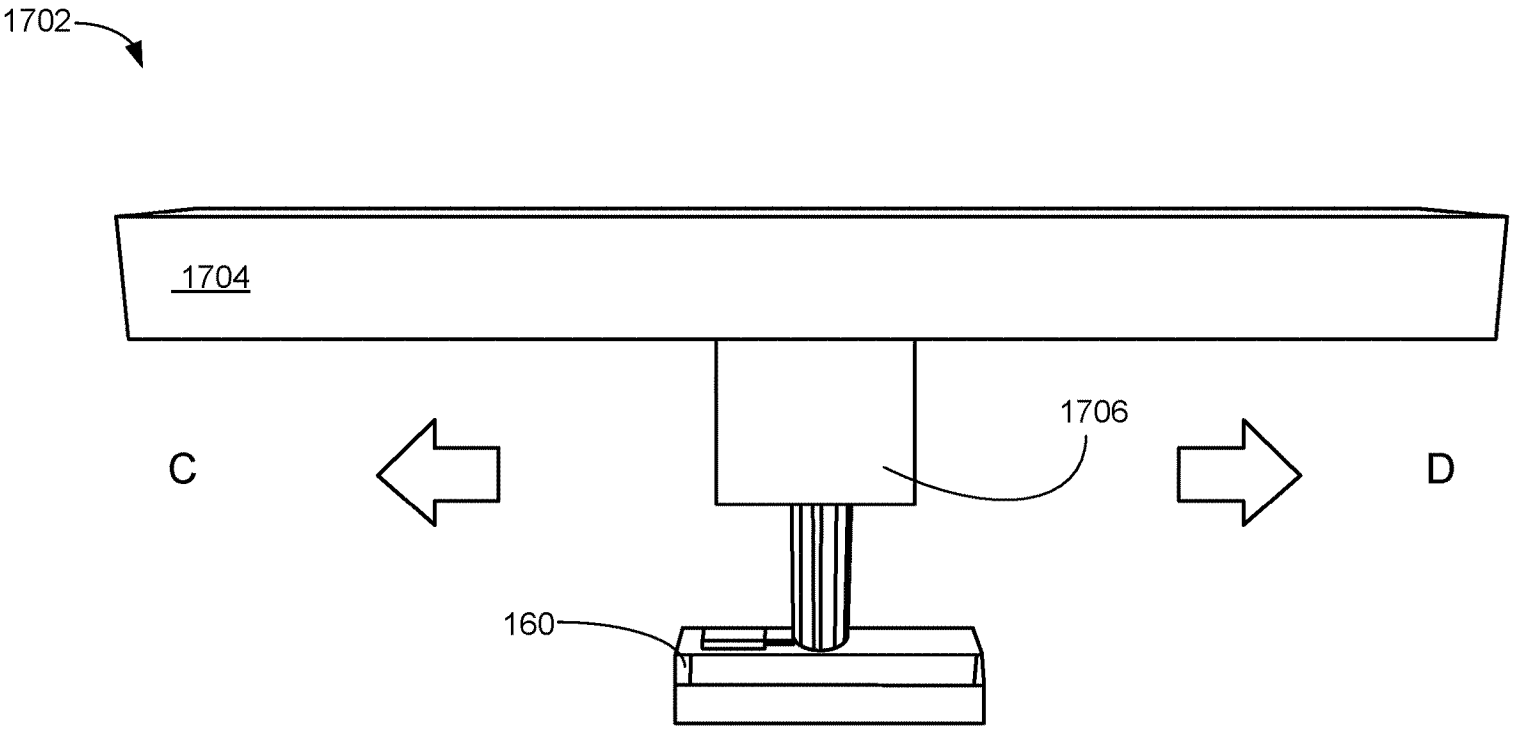
FIG. 17 is a detailed view of a delivery carriage in a second embodiment of the present invention.

Referring now to FIG. 17, therein is shown a detailed view of a delivery carriage 1702 in a second embodiment of the present invention. The delivery carriage 1702 can be similar to the delivery carriage 150 of FIG. 16, except that the delivery carriage 1702 includes a lateral rail 1704. For example, the lateral rail 1704 can be six feet in length from position "C" to position "D". The lateral rail 1704 can be attached to the anchor 1504 of FIG. 15.

The lateral rail 1704 provides for lateral movement of the training dummy 105 of FIG. 1 as opposed to the forward and back movement provided by the delivery rail 130 of FIG. 1. Lateral movement refers to movement of the delivery carriage 1702 from side to side from the perspective of the end frame side 106 of FIG. 1. For example, from a perspective from the end frame side 106, the magnetic release 160 can move left to position C and can move right to position D.

The lateral rail 1704 of the delivery carriage 1702 provides the additional ability to not only move the training dummy 105 back and forth, but also include the ability to move the bag side to side. For example, the training dummy 105 can move from the center of the lateral rail 1704 to position C, center to position D, from position C to D, and any position between position C and position D.

The delivery carriage 1702 can include a mounting anchor 1706 attach between the lateral rail 1704 and the magnetic release 160. The mounting anchor 1706 can travel laterally along the lateral rail 1704 for moving the magnetic release 160 to the left or to the right. The lateral rail 1704 can house motors, gears, wires, cables, chains, a pulley system, electromagnetic armature, or a combination thereof for moving the mounting anchor 1706 side-to-side along the lateral rail 1704.

It has been found that the lateral rail 1704 of the delivery carriage 1700 provides for greater flexibility to deliver the training dummy 105 to the athlete by utilizing lateral or side-to-side movement while training. For example, the lateral rail 1704 allows the option of moving the training dummy 105 of FIG. 1 one yard off center to the left or right at any period during the movement of the training dummy 105. This movement can model fine-tuned adjustments made by human players and allows an athlete to practice tackling a dummy that is moving laterally to avoid a tackle. The combination of front and back movement with the addition of side-to-side movement allows the training dummy 105 to better mimic the actions and travel paths of human opponents in a live sporting environment.

Figure 18:
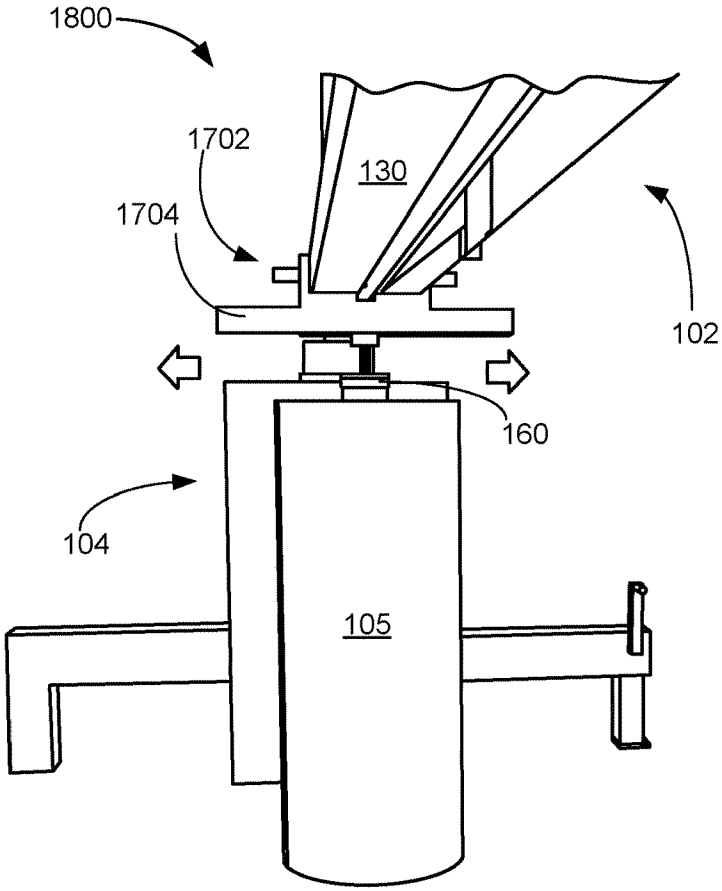
FIG. 18 is an offset end view example of a sports training safety system of the present invention in a second embodiment of the present invention.

Referring now to FIG. 18, therein is shown an offset end view example of a sports training safety system 1800 of the present invention in a second embodiment of the present invention. The sports training safety system 1800 can include the same components as the sports training safety system 100 of FIG. 1 except the sports training safety system 1800 includes the delivery carriage 1702 shown in FIG. 17.

The offset end view can show the modular design of the delivery carriage 150 of FIG. 1 and the delivery carriage 1702. Either type of carriage can be attached and removed from the delivery rail 130, which facilities maintenance, repairs, and operational flexibility. The example includes the magnetic release 160, the apparatus hub 104, the frame 102, the delivery rail 130, the lateral rail 1704, and the training dummy 105.

The lateral rail 1704 is suspended from the delivery rail 130 and can travel forward and back along the delivery rail 130. The lateral rail 1704 can move the magnetic release 160 in a direction perpendicular to the delivery rail 130, such as lateral movement along the lateral rail 1704 or side-to-side movement.

The lateral rail 1704 can be connected to the cable delivery 132 of FIG. 1 for transporting the lateral rail 1704 along the delivery rail 130. Thus, the start location 702 of FIG. 7, the first target location 704 of FIG. 7 and the second target location 706 of FIG. 7 can be at any point in range of the lateral rail 1704 and the delivery rail 130.

It has been found that the lateral rail 1704 provides mobility of the delivery carriage 1702 to any coordinate location within range of the delivery rail 130 and the lateral rail 1704 instead of being fixed to a specific location on a track. The lateral rail 1704 can provide for the appearance of a random path taken by the training dummy 105 for subsequent uses of the sports training safety system 1800. Thus, a user can recreate and practice tackling the training dummy 105 on a pre-programed travel path or the user can practice on subsequent random travel paths for the training dummy 105.

Figure 19:
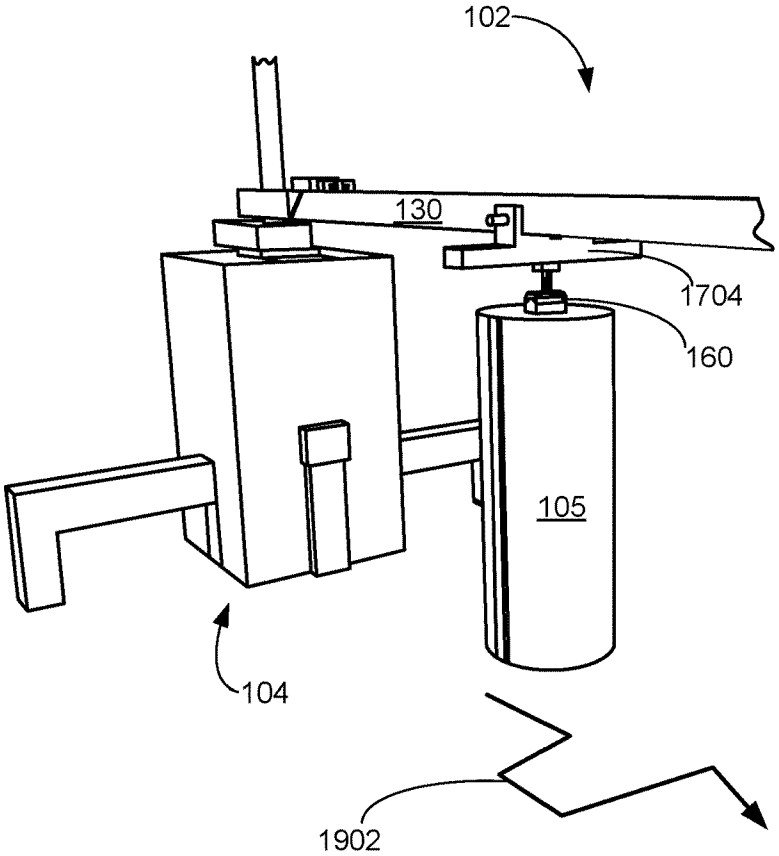
FIG. 19 is a partial isometric view of the structure in FIG. 18.

Referring now to FIG. 19, therein is shown a partial isometric view of the structure in FIG. 18. The partial view can includes the magnetic release 160, the apparatus hub 104, the frame 102, the delivery rail 130, the lateral rail 1704, and the training dummy 105.

The delivery rail 130 and the lateral rail 1704 allow the training dummy 105 to travel along different paths or routes to a final stop location. For example, the training dummy 105 can travel to any location within range of the lateral rail 1704 and the delivery rail 130.

The controller 207 of FIG. 2 can be programed with a delivery pattern 1902 for the path taken by the training dummy 105. The delivery pattern 1902 is a set of instructions for the movement, locations, travel paths, pauses, and speeds for the training dummy 105. It has been found that the delivery pattern 1902 can include stock patterns or programed patterns created by an operator of the sports training safety system 100. The stock patterns and programs can include different speeds, accelerations, and timings for each movement.

For example, the delivery pattern 1902 can include a zig-zap pattern that mimics how a football program would run to avoid being tackled. It has been found that each segment of the delivery pattern 1902 can have a programed speed, timing, and acceleration.

Further for example, the delivery pattern 1902 can mimic a quarterback's travel path in the pocket. The sports training safety system 100 can be programed to run an "L" pattern, where the training dummy 105 moves along the lateral rail 1704 and then along the delivery rail 130 to form the "L" shape. The delivery pattern 1902 can be programed to move the training dummy 105 back from position B as shown in FIG. 3 and side-to-side to mimic the actions of a quarterback.

Figure 20:
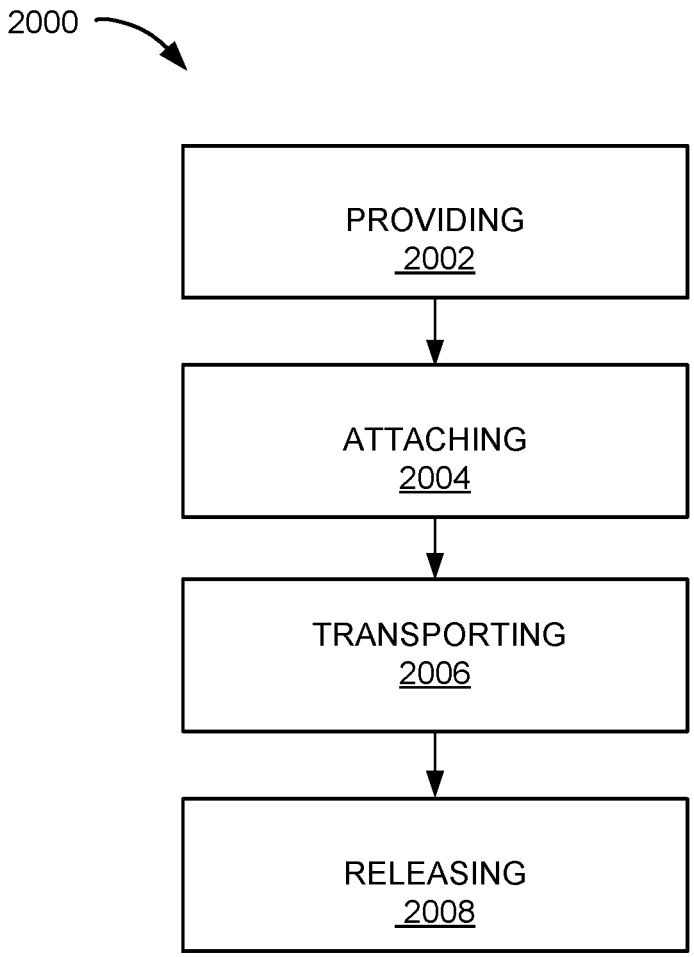
FIG. 20 is a flow chart of a method of operation of a sports training safety system, in a further embodiment of the present invention.

Referring now to FIG. 20, therein is shown a flow chart of a method 2000 of operation of a sports training safety system 100, in a further embodiment of the present invention. The method 2000 includes: providing a frame having a delivery carriage and a magnetic release, the delivery carriage attached between the frame and the magnetic release in a block 2002; attaching a training dummy to the magnetic release in a block 2004; transporting the training dummy to a target location along the frame in a block 2006; and releasing the training dummy from the magnetic release based on the target location in a block 2008.

Yet other important aspects of the embodiments include that it valuably supports and services the historical trend of reducing costs, simplifying systems, and increasing performance These and other valuable aspects of the embodiments consequently further the state of the technology to at least the next level.

Thus, it has been discovered that the sports training safety system of the present invention furnishes important and heretofore unknown and unavailable solutions, capabilities, and functional aspects for improving reliability, realism, and safety in systems. The resulting processes and configurations are straightforward, cost-effective, uncomplicated, highly versatile, and effective, can be implemented by adapting known technologies, and are thus readily suited for efficiently and economically manufacturing sports training equipment.

While the invention has been described in conjunction with a specific best mode, it is to be understood that many alternatives, modifications, and variations will be apparent to those skilled in the art in light of the aforegoing description. Accordingly, it is intended to embrace all such alternatives, modifications, and variations that fall within the scope of the included claims. All matters hithertofore set forth herein or shown in the accompanying drawings are to be interpreted in an illustrative and non-limiting sense.

What is claimed is:

1. A method, comprising:

controlling movement of a delivery carriage along a delivery rail by a controller, the delivery carriage moves linearly along the delivery rail, the delivery carriage includes a lateral rail;

magnetically attaching a training dummy to a magnetic release, the magnetic release having a sensor that detects an impact on the training dummy, the magnetic release including an electromagnet that is strength adjustable to accommodate a weight of the training dummy, the magnetic release moves laterally along the lateral rail;

stopping motion of the delivery carriage by the controller and releasing the training dummy by electrically disengaging the electromagnet upon the sensor detecting an impact on the training dummy, thereby increasing physical safety to a user during impact with the training dummy.

2. The method as claimed in claim 1, further comprising: controlling, by the controller, motion of the delivery carriage to deliver the training dummy to a target location.

3. The method as claimed in claim 1, further comprising: determining, by the controller, a delivery pattern for a path that the delivery carriage follows.

4. The method as claimed in claim 1, further comprising: adjusting, by the controller, a carriage speed and a carriage acceleration of the delivery carriage.

5. The method as claimed in claim 1 further comprising: collecting feedback information from a contact event to the training dummy.

6. The method as claimed in claim 1, wherein the sensor is a camera sensor.

7. The method as claimed in claim 1, wherein the sensor is a motion sensor.

8. The method as claimed in claim 1, wherein the sensor is an inertial sensor.

9. The method as claimed in claim 1, wherein the sensor is a pressure sensor.

10. An apparatus, comprising:

a delivery rail;

a delivery carriage attached to the delivery rail and having a linear movement along the delivery rail, the delivery carriage having a lateral rail;

a magnetic release having a lateral movement along the lateral rail, the magnetic release is magnetically attached to a training dummy, the magnetic release having a sensor that detects an impact on the training dummy, the magnetic release including an electromagnet that is strength adjustable to accommodate a weight of the training dummy;

a controller that stops motion of the delivery carriage and releases the training dummy by electrically disengaging the electromagnet upon the sensor detecting an impact on the training dummy, thereby increasing physical safety to a user during impact with the training dummy.

11. The apparatus as claimed in claim 10, wherein the controller controls motion of the delivery carriage to deliver the training dummy to a target location.

12. The apparatus as claimed in claim 10, wherein the controller determines a delivery pattern for a path that the delivery carriage follows.

13. The apparatus as claimed in claim 10, wherein the controller adjusts a carriage speed and a carriage acceleration of the delivery carriage.

14. The apparatus as claimed in claim 10, wherein the delivery carriage includes carriage wheels mounted on the delivery carriage.

15. The apparatus as claimed in claim 10, wherein the sensor is a camera sensor.

16. The apparatus as claimed in claim 10, wherein the sensor is a motion sensor.

17. The apparatus as claimed in claim 10, wherein the sensor is an inertial sensor.

18. The apparatus as claimed in claim 10, wherein the sensor is a pressure sensor.

* * * * *